US005600356A

United States Patent [19]

Sekiya et al.

[11] Patent Number: 5,600,356

[45] Date of Patent: Feb. 4, 1997

[54] LIQUID JET RECORDING HEAD HAVING IMPROVED RADIATOR MEMBER

[75] Inventors: Takuro Sekiya; Takashi Kimura; Masanori Horike; Shuji Motomura; Masami Kadonaga, all of Yokohama, Japan

[73] Assignee: Ricoh Company, Ltd., Tokyo, Japan

[21] Appl. No.: 365,069

[22] Filed: Dec. 28, 1994

Related U.S. Application Data

[63] Continuation of Ser. No. 182,374, Jan. 14, 1994, abandoned, which is a continuation of Ser. No. 888,452, May 20, 1992, abandoned, which is a continuation of Ser. No. 557,565, Jul. 24, 1990, abandoned.

[30] Foreign Application Priority Data

| | | | |
|---|---|---|---|
| Jul. 25, 1989 | [JP] | Japan | 1-192357 |
| Dec. 1, 1989 | [JP] | Japan | 1-312633 |
| Jan. 30, 1990 | [JP] | Japan | 2-20109 |
| Mar. 7, 1990 | [JP] | Japan | 2-57287 |

[51] Int. Cl.[6] ..... B41J 2/05

[52] U.S. Cl. ..... 347/62; 347/64

[58] Field of Search ..... 347/62, 61, 64, 347/15

[56] References Cited

U.S. PATENT DOCUMENTS

| | | | |
|---|---|---|---|
| 4,313,124 | 1/1982 | Hara | 347/57 |
| 4,339,762 | 7/1982 | Shirato | 347/62 |
| 4,345,262 | 8/1982 | Shirato | 347/57 |
| 4,567,493 | 1/1986 | Ikeda | 347/64 |
| 4,695,853 | 9/1987 | Hackleman | 347/62 |
| 4,792,818 | 12/1988 | Eldridge | 347/62 |
| 4,914,562 | 4/1990 | Abe | 347/62 |
| 5,021,806 | 6/1991 | Sugiyama | 346/76 PH |

FOREIGN PATENT DOCUMENTS

| | | | |
|---|---|---|---|
| 56-9429 | 4/1979 | Japan . | |
| 62-46359 | 3/1980 | Japan . | |
| 62-46358 | 3/1980 | Japan . | |
| 62-48585 | 10/1980 | Japan . | |
| 59-31943 | 10/1980 | Japan . | |
| 59-124863 | 7/1984 | Japan | B41J 3/04 |
| 59-124864 | 7/1984 | Japan | B41J 3/04 |
| 63-42869 | 2/1988 | Japan | B41J 3/04 |
| 63-42872 | 2/1988 | Japan | B41J 3/04 |

*Primary Examiner*—Joseph W. Hartary
*Attorney, Agent, or Firm*—Cooper & Dunham LLP

[57] ABSTRACT

A liquid jet recording head includes a liquid path member having a plurality of liquid flow paths, each of the liquid flow paths being filled with a recording liquid, an orifice being formed at an end of each of the liquid flow paths, and a heater base member having a plurality of heater members and a plurality of radiator members. The heater base member is connected to the liquid path member, each of the heater members having a heater portion, the heater portion generating heat in accordance with a power supplied to it. Each of the radiator members is thermally coupled to the heater portion of one of the heater members so that the amount of heat transmitted from the heater portion to the recording liquid on the heater portion changes in a predetermined direction. When a power is supplied to the heater portion, a bubble is generated in the recording liquid and located at an area on the heater portion, the area having a size corresponding to the power supplied to the heater portion, the bubble causing a recording liquid droplet to be jetted from the orifice.

3 Claims, 30 Drawing Sheets

FIG.26A
FIG.26B
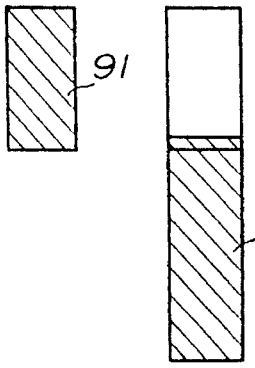
FIG.26C
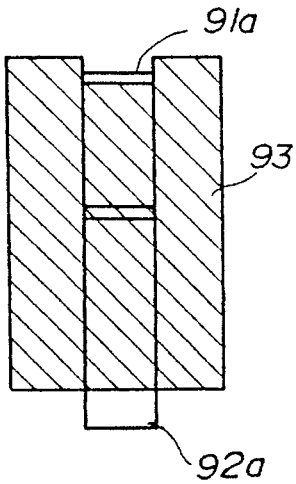
FIG.26D
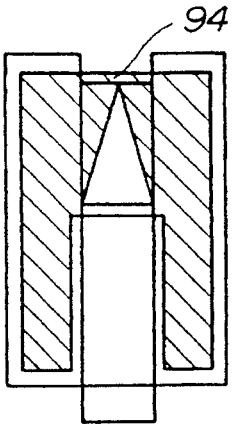
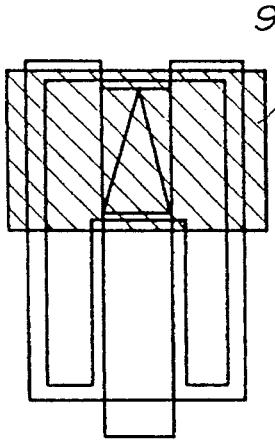
FIG.26E
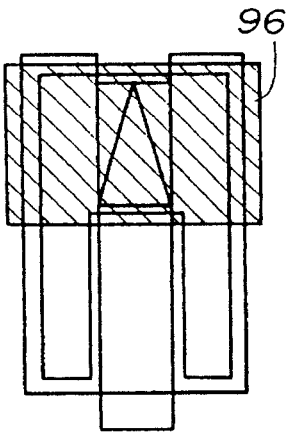
FIG.26F
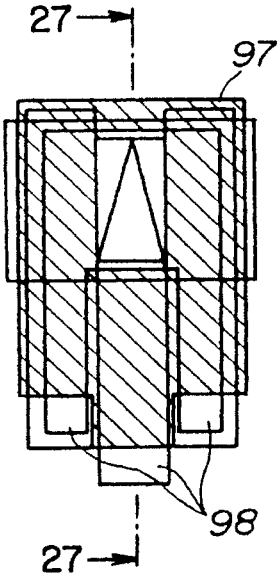
FIG.26G
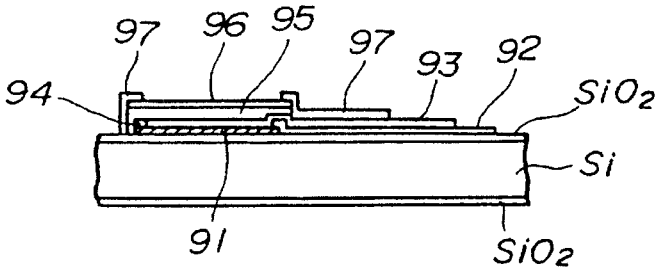
FIG.27

FIG.28A
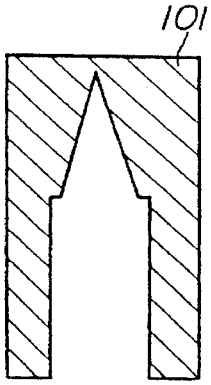
FIG.28B
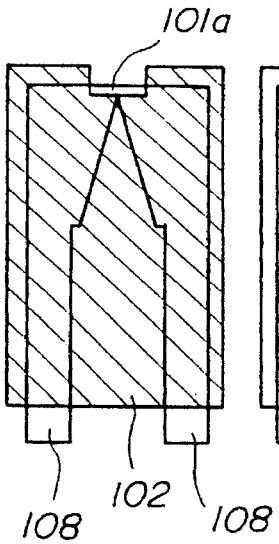
FIG.28C
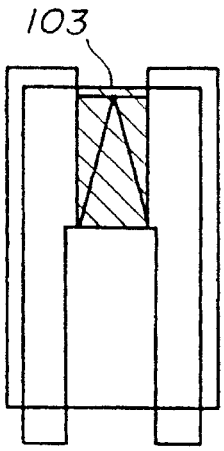
FIG.28D
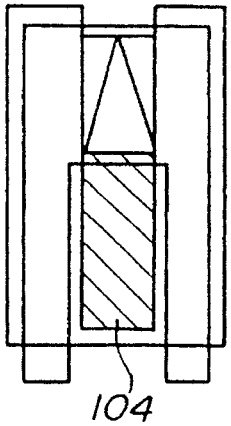
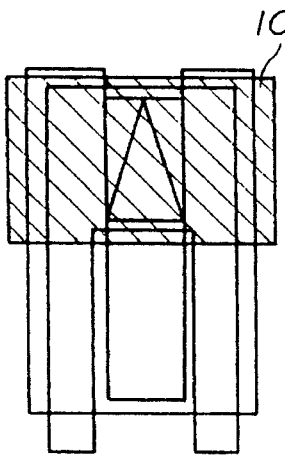
FIG.28E
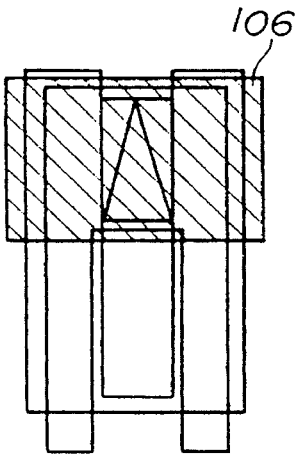
FIG.28F
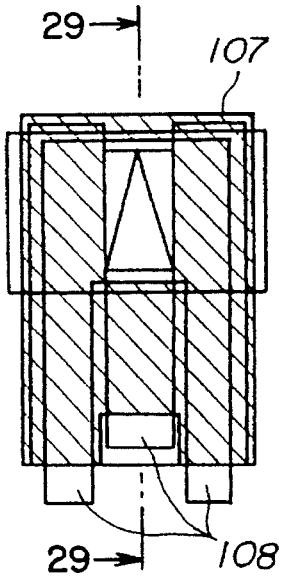
FIG.28G
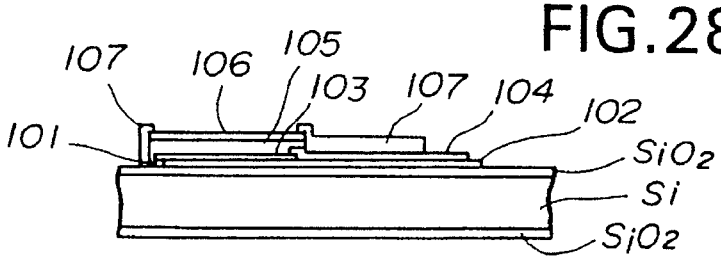
FIG.29

FIG.33
PRIOR ART
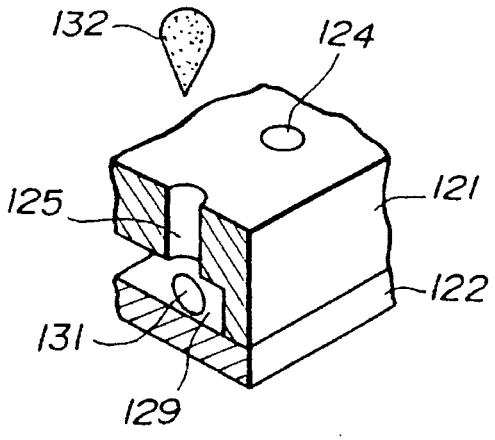
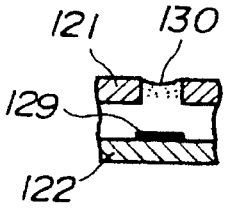
FIG.34A
PRIOR ART
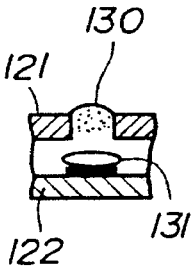
FIG.34B
PRIOR ART
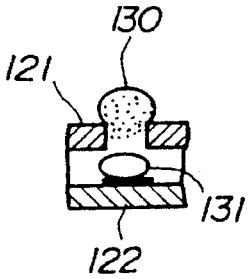
FIG.34C
PRIOR ART
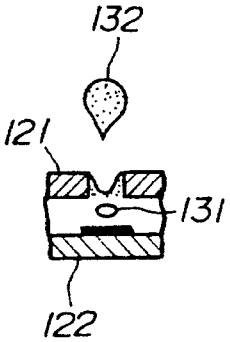
FIG.34D
PRIOR ART
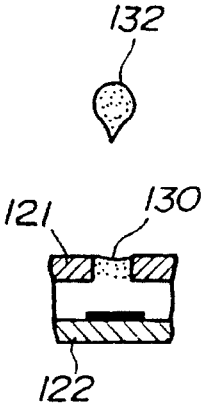
FIG.34E
PRIOR ART

LIQUID JET RECORDING HEAD HAVING IMPROVED RADIATOR MEMBER

This is a continuation of application Ser. No. 08/182,374 filed Jan. 14, 1994, now abandoned which in turn is a continuation of application Ser. No. 07/888,452 filed May 20, 1992, now abandoned, which in turn is a continuation of 07/557,565 filed Jul. 24, 1990, now abandoned.

BACKGROUND OF THE INVENTION

The present invention generally relates to a liquid jet recording head, more particularly to a liquid jet recording head capable of recording a gradational image.

In a non-impact recording method, a noise generated at the time of recording is exceedingly small. In a so called ink jet recording method which is an example of the non-impact recording method, it is possible to record an image without providing a particular process where an image is fixed on a normal paper. This ink jet recording method is particularly useful so that various recording systems using this method have been proposed.

In the ink jet recording method, droplets of recording liquid, so called ink, is jetted so as to fly from a nozzle, and then the droplets are adhered to a recording member such as a recording sheet. Because of this, an image is formed on the recording member. The ink jet recording method is classified into various systems based on the method used to generate droplets of recording liquid and to control the flying direction of the droplets.

A first system is, for example, disclosed in U.S. Pat. No. 3,060,429. This system is called the "Tele Type system". In the first system, droplets are generated due to an electrostatic force, an electric field between deflecting electrodes is controlled in accordance with the recording signal so that flying droplets are selectively adhered to the recording member.

A second system is, for example, disclosed in U.S. Pat. Nos. 3,596,275, U.S. Pat. No. 3,298,030 and the like. This second system is called the "Sweet system". In this second system, droplets are generated by a vibrator such as a continuously vibrating piezo-electric vibrator, and then the each of droplets is charged in accordance with the recording signal. The charged droplets fly between the deflecting electrodes between which the constant electric field is formed so that each of the flying droplets is adhered to a position according to the image signal on the recording member, that is, the image is formed on the recording member.

A third system is disclosed in U.S. Pat. No. 3,436,153. This third system is called the "Hertz system". In this third system, the electric field is formed between the nozzle and a ring-shaped electrode, and droplets of the recording liquid are generated and atomized by the continuously vibrating vibrator. That is, the intensity of the electric field between the nozzle and the electrode is controlled in accordance with the recording signal so that the tomizing state of each of the droplets is controlled. Then the gradational image corresponding to the atomizing state of each of droplets is recorded on the recording member.

A fourth system is disclosed in U.S. Pat. No. 3,747,120. This fourth system is called the "Stemme system". The A principle of this fourth system essentially differs from each of the principles of the three systems described above. That is, in this fourth system, a piezo-electric vibrator is provided corresponding to each of the nozzles jetting droplets of recording liquid in the recording head, and then image signals are selectively supplied to the piezo-electric vibrators. Each of the piezo-electric vibrators converts the recording signal into a mechanical vibration, and droplets of the recording liquid are jetted so as to fly from each of the nozzles in accordance with the mechanical vibration of a corresponding piezo-electric vibrator.

In the first, the second and the third systems, the main energy for generating droplets of recording liquid is electrical energy and each of the droplets is deflected due to the controlling of the electric field. Therefor, in the first system, the structure of the recording head is simple, however it is necessary to supply a high voltage to the electrodes for generating droplets, and it is difficult to provide a recording head having a multinozzle structure so that this system is unsuitable for quickly recording an image.

In the second system, it is possible to provide the recording head having the multinozzle structure so that this system is suitable for quickly recording an image, however the structure of the recording head is complicated, and it is necessary to perform an advanced controlling operation for generating droplets. In addition, satellite dots which are positioned around the regular dot are formed in the image on the recording member with ease.

In the third system, droplets of the recording liquid are atomized so that it is possible to form an excellent gradational image, however it is difficult to control the atomizing state of each of the droplets, and images easily overlap with each other. In addition, it is difficult to provide the recording head having the multinozzle structure so that the third system is unsuitable for quickly recording an image.

In the fourth system, the structure of the recording head is simple, and only droplets corresponding to dots making up the image are jetted and fly from the nozzle (the on-demand system) so that it is unnecessary to draw back droplets of recording liquid which are unused for recording image. In the first, the second and the third systems, it is necessary to draw back droplets of recording liquid which are unnecessary for recording an image. In addition, it is unnecessary to use the conductive recording liquid for recording an image so that it is possible to select variouse type of recording liquids. However, it is difficult to make the recording head. It is also extremely difficult to miniaturize the piezo-electric vibrator having a required resonance frequency so that it is difficult to provide the recording head having the multinozzle structure. Droplets of the recording liquid are jetted and flown from the nozzle by a mechanical energy such as the mechanical vibration of the piezo-electric vibrator so that the fourth system is unsuitable for quickly recording an image.

An ink jet recording system in which the disadvantages of the first through the fourth systems described above are eliminated is proposed. This ink jet recording system is disclosed in Japanese Patent Publication No. 56-9429. In the disclosed ink jet recording system, ink in a liquid cavity is heated so that a bubble is generated and pressure in the ink suddenly increases. Then, due to the increasing of the pressure in the ink, a droplet is jetted from a narrow capillary nozzle.

Furthermore, an improved ink jet recording system is disclosed in Japanese Patent Publication No. 59-31943. In the improved ink jet recording system, electric heat conversion elements each having a heating portion and being capable of controling the amount of heat generated are provided. A signal having the gradational information is supplied to each of the electric heat conversion elements so that each of the heating portions heats the ink in accordance with the signal. As a result, the gradational image is recorded on a recording medium such as a recording sheet.

A description will now be given of the structure of one of the electric heat conversion elements described above. The structure of one of the electric heat conversion elements is, for example, shown in FIGS. 1 through 7.

In FIGS. 1 through 5, a heat reserve layer 72 and a heater layer 73 are stacked on a base 71.

A pair of electrodes 74 and 75 are formed on the heater layer 73. There is a gap Δl between the pair of electrodes 74 and 75. A protection layer 76 is formed so as to cover the heat layer 73 and the pair of electrodes 74 and 75. A set of layers positioned in the gap Δl forms a heater portion.

In the structure shown in FIG. 1, the thickness of the protection layer 76 in the heater portion (Δl) decreases in the direction going from an end (B) of the electrode 74 to an end (A) of the electrode 75. Therefore, the amount of heat supplied to the liquid through the surface of the heater portion (which is the surface of the protection layer 76) to the liquid for a predetermined time increases in the direction going from the end (B) of electrode 74 to the end (A) of the electrode 75. That is, in the amount of heat supplied through the surface of the heat portion to the liquid, the thermal gradient is generated.

In the structure shown in FIG. 2, the thickness of the heat reserve layer 72 in the heater portion (Δl) decreases in the direction going from the end (A) of the electrode 74 to the end (B) of the electrode 75. Therefore, the amount of the heat radiation from the heater layer 73 to the base 71 increases in the direction going from the end (A) of the electrode 74 to the end (B) of the electrode 75. As a result, the amount of heat supplied to the liquid for the predetermined time increases in the direction (B) to (A).

In the structure shown in FIG. 3, the thickness of the heater layer 73 in the heater portion (Δl) decreases in the direction going from the end (B) of the electrode 74 to the end (A) of the electrode 75. Therefore, the resistance of the heater layer 73 increases in the direction going from the end (B) of the electrode 74 to the end (A) of the electrode 75 so that the amount of heat generated by the heater layer 73 increases in the direction going from (B) to (A). As a result, the amount of heat supplied to the liquid for the predetermined time increases in the direction (B) to (A).

FIGS. 4 through 7 also show plan views of the structures of the electric heat conversion element disclosed in Japanese Patent Publication No. 59-31943. In each of the structures shown in FIGS. 4 through 7, an electrode 82 is connected to an end of a heater portion 81 and an electrode 83 is connected to another end of the heater portion 81.

In FIG. 4, the planar structure of the heater portion 81 is rectangular. An area where the electrode 82 and the heater portion 81 are connected with each other is narrower than an area where the electrode 83 and the heater portion 81 are connected with each other. In each of the examples shown in FIGS. 5 and 6, the heater portion 81 has a planar structure in which the width of the center of the heater portion 81 is narrower than each of the widths of both ends thereof. In an example shown in FIG. 6, the planar structure of the heater portion 81 is a trapezoid. Each of the edges of the heater portion which are non-parallel with each other is connected to one of the electrode 82 and 83.

In an example shown in FIG. 7, the heater portion 81 has a planar structure in which each of the widths of both ends of the heater portion 81 is narrower than the width of the center thereof. In each of the examples shown in FIGS. 4 through 7, the current density in the heater portion 81 decreases in the direction going from a position (A) to a position (B). Therefor, the level of the power supplied to the heater portion 81 is controlled so that the area where the bubble is generated by the heating function of the heater portion 81 is changed. As a result, the size of the bubble is controlled so that the size of the droplet jetted from the nozzle is controlled. Thus, it is possible to record the gradational image.

However, In the examples shown in FIGS. 1 through 3, it is very difficult to form the structure in which the thickness of the heat portion changes by the thin film forming process. Even if possible, the cost of production would be very high. In the device having the structure in which a pattern of the heater portion changes as shown in FIGS. 4 through 7, the pattern can be broken at the narrowest portion thereof with ease so that the durability of the heater portion is poor.

A gradational image recording system recording the gradational image is also disclosed in Japanese Laid-Open Patent Application No. 63-42872. In this recording system, it is difficult to produce the heater portion in the same manner as the examples described above. In addition, a gradational image recording system is disclosed in Japanese Patent Publication No. 62-46358, Japanese Patent Publication No. 62-46359, and Japanese Patent Publication No. 62-48585. In this type of recording system, a plurality of heater elements are provided on one liquid path or one nozzle so that the number of control electrodes connected to the plurality of heater elements increases and it is difficult to increase density of the nozzles. A recording system disclosed in Japanese Laid-Open Patent Application No. 59-124863 and Japanese Laid-Open Patent Application No. 59-124864 has a heater portion for jetting droplets and another heater portion and bubble generator for generating bubbles. Therefor, it is difficult to increase the density of nozzles. Furthermore, in another recording system disclosed in Japanese Laid-Open Patent Application No. 63-42869, the number of generated bubbles is controlled so that the amount of ink jetted from a nozzle is controlled. It is generally impossible to supply much power to the heater element in the bubble jet type recording system. Thus, in this type of recording system, durability is poor.

As has been described above, in the conventional liquid jet recording system, there are disadvantages from the point of view of the durability of the system and the increase in the density of the nozzles in the system and so on.

SUMMARY OF THE INVENTION

Accordingly, a general object of the present invention is to provide a novel and useful liquid jet recording head in which the disadvantages of the aforementioned prior art are eliminated.

A more specific object of the present invention is to provide a liquid jet recording head which can be produced with ease and is durable.

Another object of the present invention is to provide a liquid jet recording head for which it is possible to record the gradational image and to arrange a high density of nozzles.

The above objects of the present invention can be achieved by a liquid jet recording system comprising a liquid path member having a plurality of liquid flow paths, each of said liquid flow paths being filled with a recording liquid, an orifice being formed at an end of each of said liquid flow paths, and a heater base member having a plurality of heater members and a plurality of radiator members, said heater base member being connected to said liquid path member so that each of said heater members corresponds to one of said liquid paths of said liquid path member, each of said heater members having a heater portion which has a predetermined area, said heater portion generating heat in accordance with a power supplied to it, each of said radiator members being thermally coupled to said heater portion of one of said heater members so that the amount of heat transmitted from said heater portion to the recording liquid on said heater portion changes in a predetermined direction, wherein, when a power is supplied to said heater portion, a bubble is generated in the recording liquid and located at an area on said heater portion, said area having a size corresponding to the power supplied to said heater portion, said bubble causing a recording liquid droplet to be jetted from said orifice.

Additional objects, features and advantages of the present invention will become apparent from the following detailed description when read in conjunction with the accompanying drawings.

BRIEF DESCRIPTION OF THE DRAWINGS

FIG. 26*a*–26*g* shows an embodiment of the production process of the heater part;

FIG. 27 is a cross sectional view taken along line 27—27 in FIG. 26 (g);

FIG. 28*a*–28*g* shows another embodiment of the production process of the heater part;

FIG. 29 is a cross sectional view taken along line 29—29 in FIG. 28 (g);

FIG. 33 is a partially sectional perspective view illustrating the basic structure of the bubble jet recording head of the side shooter type;

FIG. 34*a*–34*e* shows a principle of generating the ink droplet ;

DESCRIPTION OF THE PREFERRED EMBODIMENTS

Figure 9:
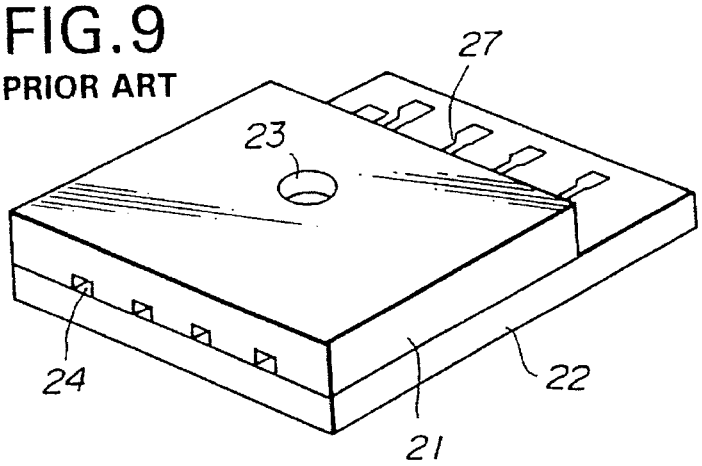
FIG.9 PRIOR ART
FIG. 9 is a perspective view of an example of a bubble jet recording head.
Figure 11A:
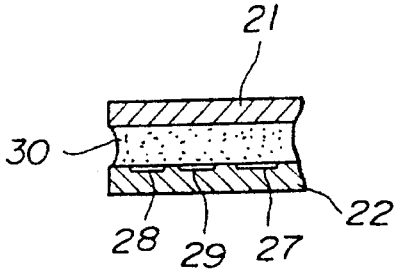
FIG.11A PRIOR ART
FIG. 11 shows a process of jetting droplets of recording liquid.
Figure 11B:
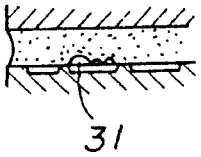
FIG.11B PRIOR ART
Figure 11C:
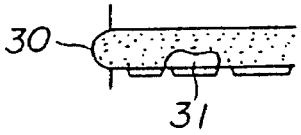
FIG.11C PRIOR ART
Figure 11D:
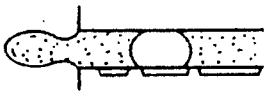
FIG.11D PRIOR ART
Figure 11E:
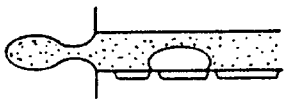
FIG.11E PRIOR ART
Figure 11F:
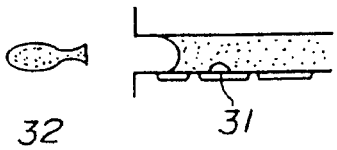
FIG.11F PRIOR ART
Figure 11G:
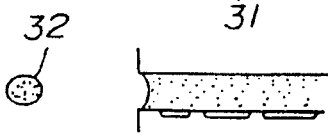
FIG.11G PRIOR ART
Figure 10A:
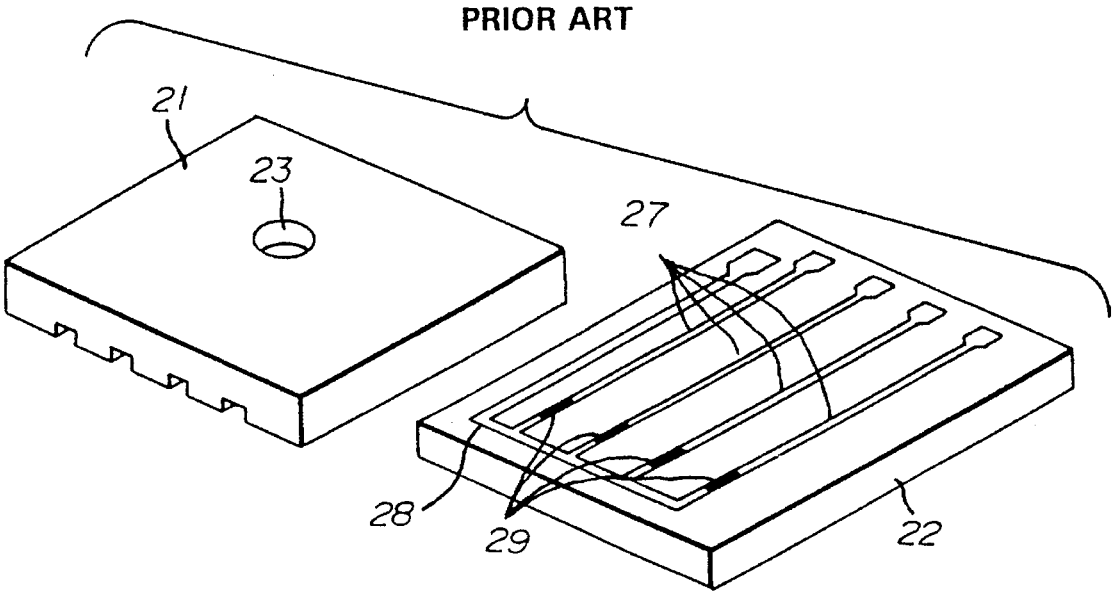
FIG. 10A PRIOR ART
FIG. 10A is an exploded perspective view of the bubble jet recording head.
Figure 10B:
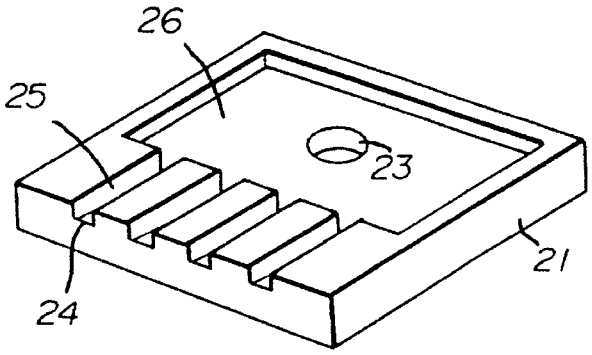
FIG. 10B PRIOR ART
FIG. 10B is a perspective view illustrating the inside of a lid base shown in FIGS. 8 and 9.

A description will now be given of the basic structure of a bubble jet recording head which is a type of liquid jet recording head according to the present invention with reference to FIGS. 9 10A and 10B. FIG. 9 is a perspective view of an example of the bubble jet recording head, FIG. 10A. is an exploded perspective view of the bubble jet recording head, and FIG. 10B is a perspective view illustrating the inside of a lid base.

In FIGS. 9 and 10, this bubble jet recording head has a lid base 21 and a heater base 22. The lid base 21 has a plurality of flow paths 25 and a liquid cavity 26. Each of the plurality of flow paths 25 is connected to the liquid cavity 26. An orifice 24 is formed on an end of each of the flow paths 25. An inflow inlet 23 is formed at the center of the liquid cavity 26. The heater base 22 has a plurality of heater elements 29. Each of the heater elements 29 corresponds to one of the flow paths 25 formed on the lid base 21. Independent electrodes 27 are formed on the heater base 22 so that each of the independent electrodes 27 contacts an end of one of the heater elements 29. A common electrode 28 commonly contacts each of the other ends of heater elements 29.

A description will now be given of a process of jetting droplets of recording liquid (ink) with reference to FIG. 11. FIG. 11 shows a first state (11A) through a seventh state (11G).

(11A) In a first state which is a stationary state, the surface tension of ink 30 and the atomospheric pressure are well balanced with each other at a surface of the orifice.

(11B) In a second state, electric power is supplied to the heater element 29 so that the temperature on the surface of the heater element 29 rapidly increases and an ink layer adjacent to the surface of the heater element 29 boils. Then, small bubbles are generated on the surface of the heater element 29.

(11C) In a third state, the ink layer adjacent to the surface of the heater element 29 is vary rapidly heated and vaporized, and then a vapor film is generated on the surface of the heater element 29 so that a bubble 31 grows up. At this time, the internal pressure in the nozzle increases in accordance with the growth of the bubble 31 so that the internal pressure and the atomospheric pressure are unbalanced in relation to each other. Then, an ink pole starts to grow from the surface of the orifice.

(11D) In a fourth state, when the bubble 31 grows to a maximum, an ink having a volume corresponding to the volume of the bubble 31 is pushed out from the orifice. At this time, the power supplied to the heater element 29 has been cut off so that the surface temperature of the heater element 29 decreases. The volume of the bubble 31 reaches a maximum slightly after electric power is supplied to the heater element 29.

(11E) In a fifth state, the bubble 31 is cooled by the ink and the like so that the bubble 31 starts to contract. A front end of the ink pole moves forward at a speed which is obtained when the ink is pushed out from the orifice. On the other hand, the internal pressure in the nozzle decreases due to the contracting of the bubble 31 so that a rear end of the ink pole is pulled insde the nozzle. Therefore, the structure of the ink pole is constricted in the rear end.

(11F) In a sixth state, the bubble 31 contracts more, and the ink contacts the surface of the heater element 29 so that the surface of the heater element 29 is rapidly cooled. At the surface of the orifice, the atomospheric pressure is greater than the internal pressure in the nozzle so that a meniscus of the ink moves in the nozzle. A ink droplet is formed from the front end of the ink pole, and then the ink droplet 32 flies to a recording sheet at a speed of 5~10 m/sec.

(11G) In a seventh state, which is the final state, the ink is refilled in the flow path due to the capillarity. Then, while returning to the first state (a), the bubble 31 completely disappears.

A description will now be given of the structure in an essential part of the bubble jet recording head with reference to FIGS. 12A and 12B and to FIG. 13.

Figure 12A:
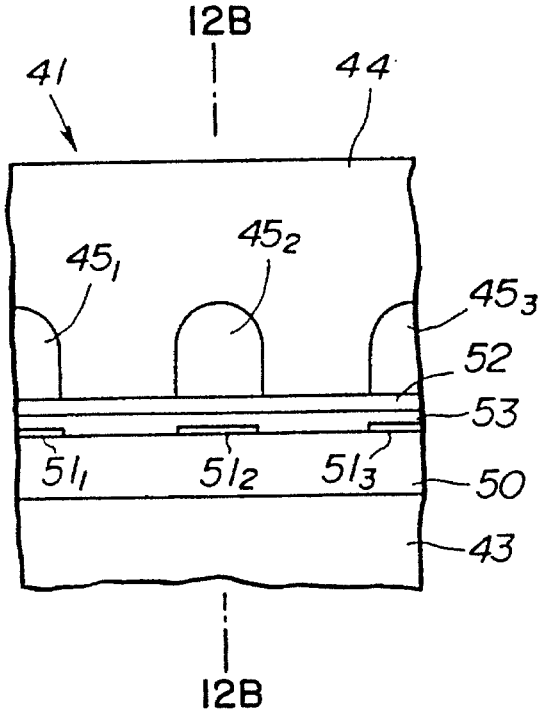
FIG. 12A PRIOR ART
FIG. 12A is a detailed elevational view illustrating the structure of the bubble jet recording head.

FIG. 12A is a detailed elevation view illustrating the structure of the bubble jet recording head. FIG. 12B is a cross sectional view taken along one dotted line 12B—12B shown in FIG. 12A.

Figure 12B:
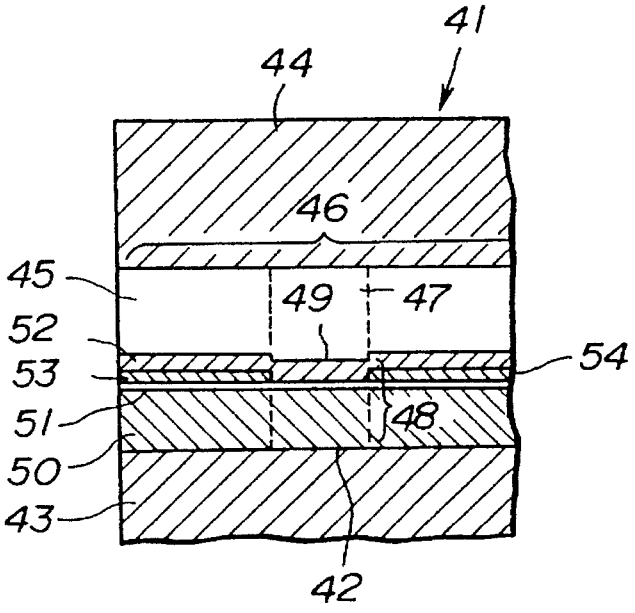
FIG. 12B PRIOR ART
FIG. 12B is a cross sectional view taken along one dotted line X—X shown in FIG. 12A.

Referring to FIGS. 12A and 12B, a recording head 41 has a base 43 and a groove plate 44. A plurality of electric heat conversion elements 42 (heater elements) are formed on the base 43. A plurality of grooves are formed on the groove plate 44 in a predetermined linear density. Each of the grooves has a predetermined width and a predetermined depth. The base 43 and the groove plate 44 are connected with each other so that each of the electric heat conversion elements 42 faces to one of the grooves. Because of the structure described above, a ink jetting part 46 corresponding to each of the grooves is formed in the recording head 41. Each of the ink jetting parts 46 includes an orifice 45 and a heat operation part 47. The heater part is a part where heat energy generated by each of the electric heat conversion element 42 is given to the ink so that a bubble is generated. Then, the volume of the bubble rapidly grows and rapidly contracts in the heat operation part 47.

Each of the heat operation parts 47 is positioned on a heat generating part 48 of each of the electric heat conversion elements 42. Each of the heat operation parts 47 has a heat operation surface 49 which is in contact with the respective heat generating part 48. The heat generating part 48 has a lower layer 50 formed on the base 43, a heating resistance layer 51 formed on the lower layer 50 and an upper layer 52 formed on the heating resistance layer 51. An electrode 53 and an electrode 54 are separated into each other and these electrodes 53 and 54 are formed on the heating resistance layer 51. The electric power is supplied through the electrodes 53 and 54 to the heating resistance layer 51. The electrode 53 is a common electrode and is connected to all heating resistance layers 51 in parallel. The electrode 54 is provided along a flow path of the ink jetting part 46 and connected to one of heating resistance layer 51. That is, the electrode 54 is a selecting electrode to selectively supply the electric power to the heating resistance layer 51.

The upper layer 52 is a protection layer which chemically and physically protects the heating resistance layer 51 against the used ink. The heating resistance layer 51 and the ink filling the flow path of the ink jetting part 46 are separated with each other by the upper layer 52. The upper layer 52 prevents the electrodes 53 and 54 from electrically shorting through the ink and the current from leaking between adjacent electrodes.

The flow path provided to each of the ink jetting parts 46 is connected to the ink cavity (not shown in FIGS. 12A and 12B) upstream.

Figure 13:
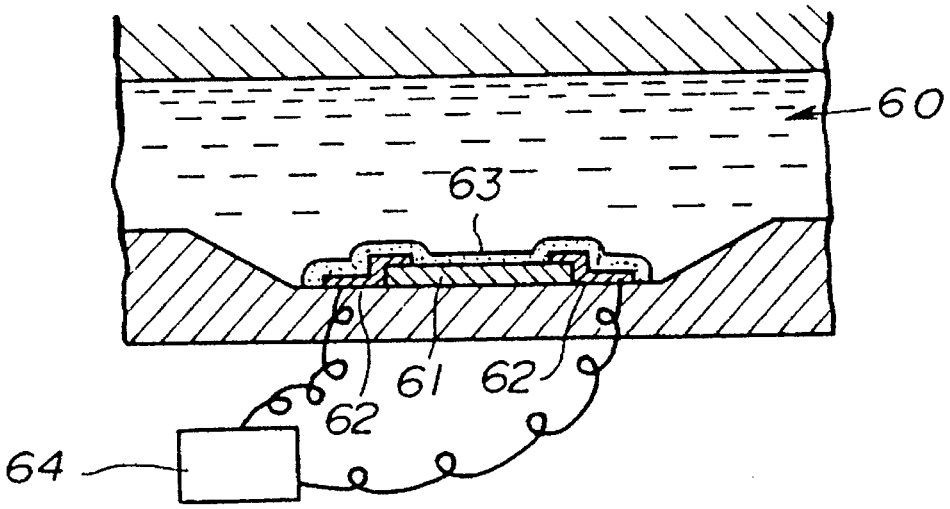
FIG. 13 PRIOR ART
FIG. 13 illustrates the basic structure of a part where the heating resistance layer is provided and the bubble is generated.

FIG. 13 illustrates the basic structure of a part where the heating resistance layer is provided and the bubble is generated.

Referring to FIG. 13, a heating resistance layer 61 is provided in a flow path 60 of the ink. Electrodes 62 are separately connected to the heating resistance layer 61. A protection layer 63 covers the heating resistance layer 61 and electrodes 62. Each of the electrodes 62 is connected to a power source 64.

The heating resistance layer 61 is, for example, made of tantalum-$SiO_2$ mixture, tantalum nitride, nickel-chromium alloy, silver-palladium alloy or silicon semiconductor. The heating resistance layer 61 can be also formed of the boride of metals such as hafnium, lanthanum, zirconium, titanium, tantalum, tungsten, molybdenum, niobium, chronium and vanadium. The boride is suited for use as a material of the heating resistance layer 61. Of the materials tested the hafnium boride is most suited for use as the material thereof. Zirconium boride, lanthanum boride, tantalum boride, vanadium boride and niobium boride are next suited for use as a material of the heater resistance layer 61.

The heater resistance layer 61 made of the material as has been described above is formed on the base by a process such as electron-beam evaporation and spattering. A thickness of the heater resistance layer 61 is determined so that the amount of heat in a unit time becomes equal to a predetermined amount. The thickness of the heater resistance layer 61 is determined in accordance with an area thereof, material forming the heater resistance layer 61, the shape and capacity of the heat operating part and the consumed power and so on. The thickness of the heater layer 61 is normally in a range of 0.001 μm to 5 μm, and is desirably in a range of 0.01 μm to 1 μm.

The electrode 62 is made of material normally used for an electrode. The electrode 62 is formed of material such as Al, Ag, Au, Pt and Cu. The electrode 62 is formed on the base so as to be in contact with the heater resistance layer 61 by a process such as evaporation.

The protection layer 63 protects the heater resistance layer 61 against the ink without preventing the heat generated from heater resistance layer 61 from efficiently transmitting to the ink. The protection layer 63 is made of material such as silicon oxide, silicon nitride, magnesium oxide, aluminium oxide, tantalum oxide and zirconium oxide. The protection layer 63 is formed on the heater resistance layer 61 and the electrodes 62 by a process such as electron-beam evaporation and spattering. The thickness of the protection layer 63 is normally in a rage of 0.01 μm to 10 μm, and is desirably in a range of 0.1 μm to 5 μm. The thickness of the protection layer 63 is most desirably in a range of 0.1 μm to 3 μm.

In the preferred embodiment of the present invention, the liquid jet recording head has the basic structure and the function as has been described above.

A detailed description will now be given of an example of a liquid jet recording head according to the present invention.

Figure 14A:
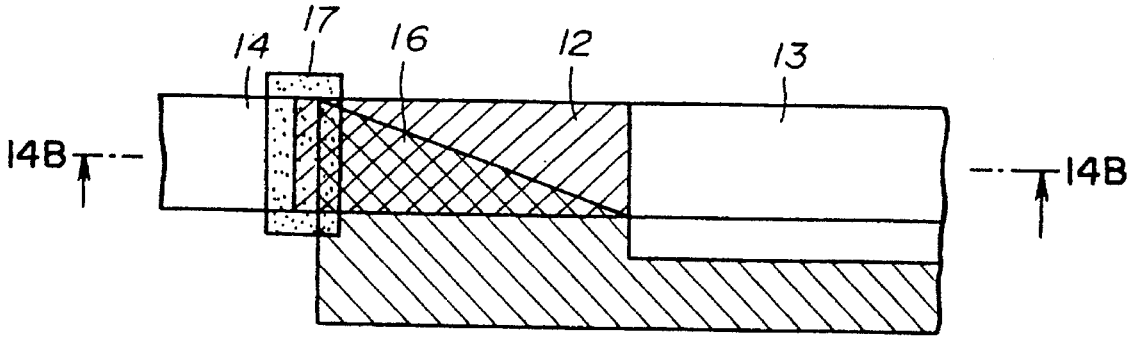
FIGS. 14A and 14B show a first embodiment of the present invention.
Figure 14B:
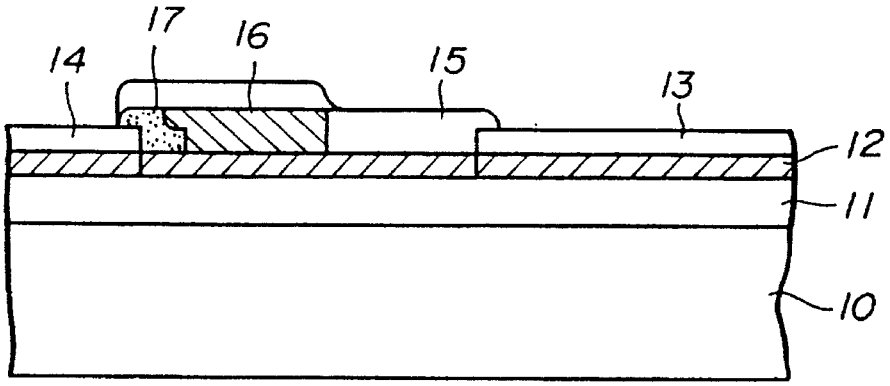

FIG. 14A is plan view showing the structure in an essential part (heater element portion) of the bubble jet recording head. FIG. 14B is a cross sectional view taken along one dotted line 14—14 shown in FIG. 14A.

Referring to FIGS. 14A and 14B, a bubble jet recording head has a base 10, a heat reserve layer 11, a heater element layer 12, a controlling electrode 13, an earth electrode 14, a protection layer 15, a radiator layer 16 and an insulation layer 17. A heating part of the heater element layer 12 is formed between the controlling electrode 13 and the earth electrode 14. The radiator layer 16 is formed on the heater element layer 12. The radiator layer 16 inequably covers the surface of the heater element layer 12. That is, the area where the radiator layer 16 covers the surface of the heater layer 12 gradually increases in the direction going from an end of the controlling electrode 13 to an end of the earth electrode 14. In this case, the heating part of the heater element layer 12 is divided into two half areas by a diagonal line thereof, and then one of two half areas is covered by the radiator layer 16. Thus, due to the function of the radiator layer 16, the amount of heat which is transmitted from heater element layer 12 to ink gradually decreases in the direction going from the end of the controlling electrode 13 to the end of the earth electrode 14. That is, a thermal gradient is generated in the ink above the heating part of the heater element layer 12. The radiator layer 16 is made of a material in which the coefficient of thermal conductivity is large and a thin film forming process such as a evaporation process and a spattering process and a photo-etching process are performed with ease. The radiator layer 16 is desirably, for example, made of Al and Au. The radiator layer 16 is formed on the heater element layer 12 so as to cover the half area of the heater element layer 12. Thus, the radiator layer 16 is formed with ease and the structure of the radiator layer 16 is simple. The insulation layer 17 is formed on the heater element layer so as to be positioned between the radiator layer 16 and the earth electrode 14.

In the bubble jet recording head having the structure as has been described above, energy corresponding to image information is supplied to the heater element layer 12. That is, voltage corresponding to image information is supplied to the controlling electrode 13. In the art of bubble jet recording system, the surface temperature of the heater element layer becomes equal to or greater than a predetermined temperature in a moment so that the bubble is generated in the ink on the heater element layer due to the film boiling phenomenon. That is, it is necessary for the temperature of the ink to become equal to or greater than a critical temperature so that the film boiling phenomenon in the ink may be generated. If size of an area where the temperature of the ink reaches the critical temperature is controlled, it is possible to control size of the bubble.

Figure 15:
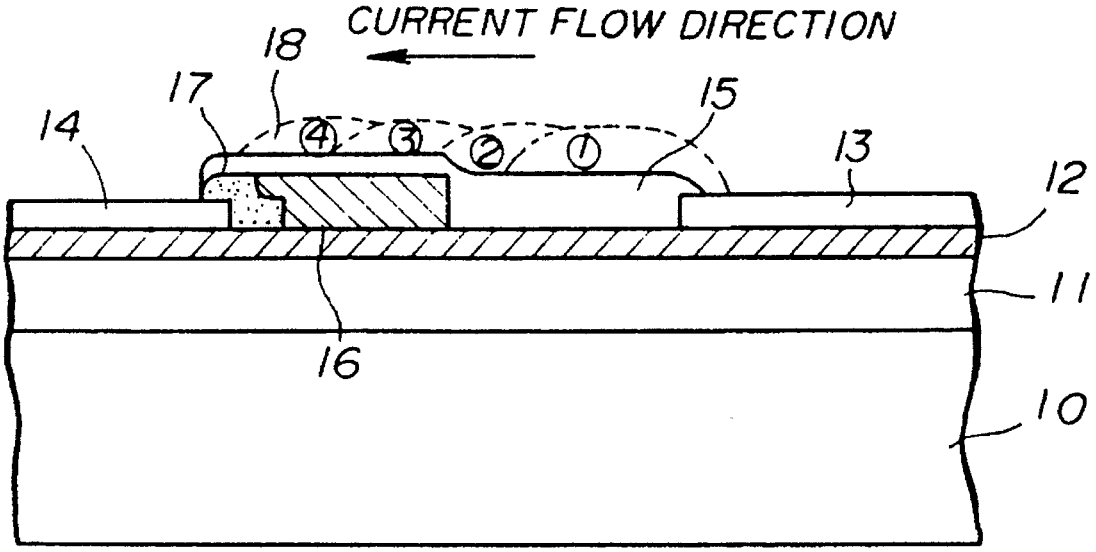
FIG. 15 shows the principle by which the bubble is generated.

FIG. 15 shows a principle in which the bubble is generated. The structure of the heating part shown in FIG. 15 is the same structure as shown in FIGS. 14A and 14B. In FIG. 15, the generated bubble is shown by the dotted line. Due to the radiator layer 16 formed on the heater element layer 12, when the power is supplied to the heater element layer 12, the thermal gradient in the direction going from the controlling electrode 13 to the earth electrode 14 is generated in the ink over the heater element layer 12. The direction going the controlling electrode 13 to the earth electrode 14 is a current flow direction. Thus, the power supplied to the heater element layer is successively changed from a small value to a large value so that the size of area where the temperature of the ink reaches the critical temperature successively becomes large in accordance with the thermal gradient. That is, the size of the bubble generated due to the film boiling phenomenon successively becomes large. For example, when the power supplied to the heater element layer 12 is successively changed from the small value to the large value, the size of the bubble 18 successively increases so as to be ①, ②, and ④ in this order, as shown by the dotted line in FIG. 15.

Figure 17:
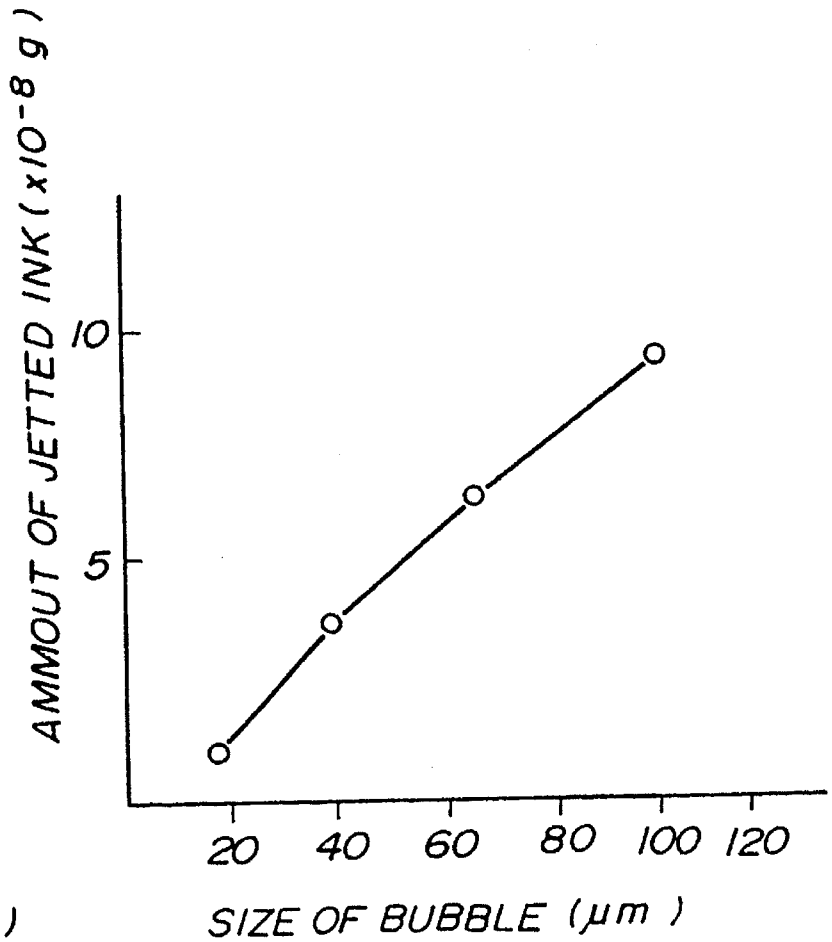
FIG. 17 is a graph indicating the relationship between the size of the generated bubble and the amount of the ink jetted from the nozzle.
Figure 16:
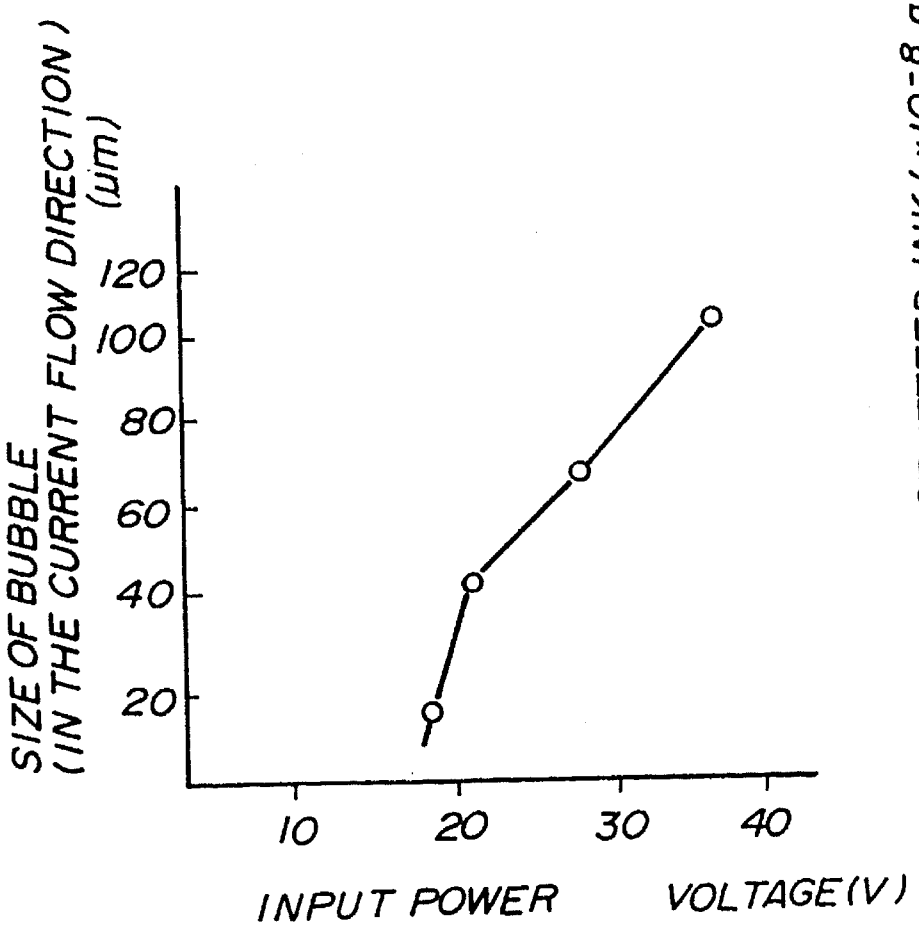
FIG. 16 is a graph indicating the relationship between the input power and the size of the generated bubble.

FIG. 16 is a graph indicating a relationship between the input power and the size of the generated bubble. FIG. 17 is a graph indicating a relationship between the size of the generated bubble and the the amount of the ink jetted from the nozzle. For example, the level of the pulse voltage supplied to between the electrodes 13 and 14 is changed or the width of the pulse voltage supplied to between the electrodes 13 and 14 so that the input power to the heater element layer 12 is changed. It is desirable that the level of the pulse voltage is changed in order to generate the bubble in a moment due to the film boiling phenomenon. There is no problem when the width of the pulse voltage is changed by a maximum of approximately 50 μsec.

Figure 4:
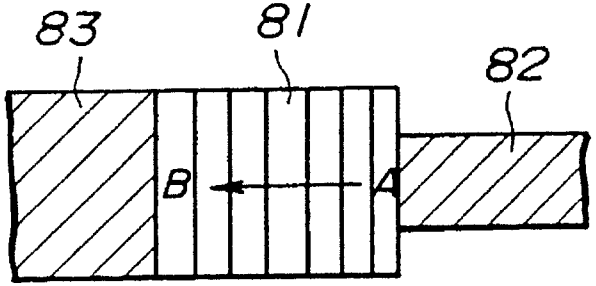
FIG. 4 PRIOR ART
Figure 5:
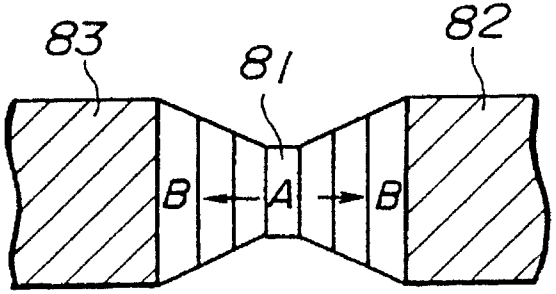
FIG. 5 PRIOR ART
Figure 6:
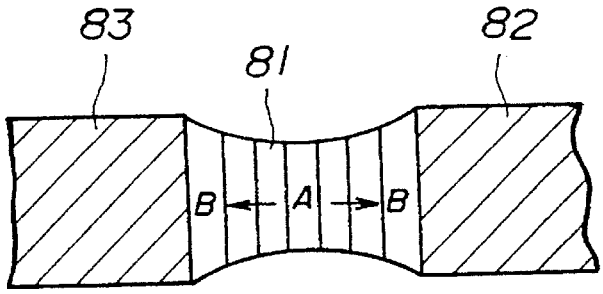
FIG.6 PRIOR ART
Figure 7:
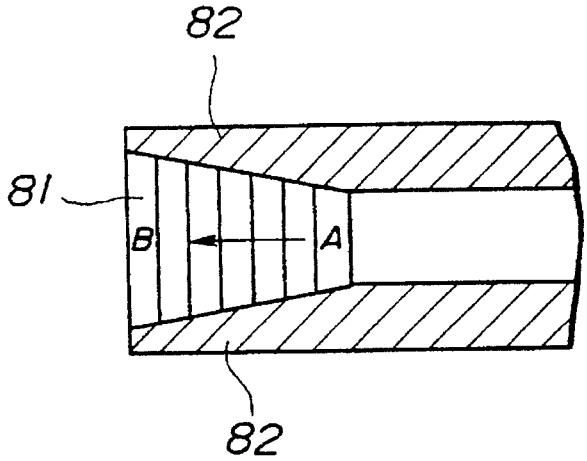
FIG.7 PRIOR ART
Figure 8:
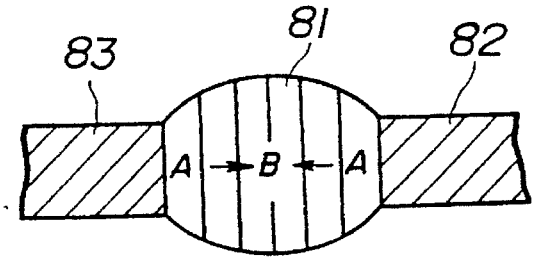
FIG.8 PRIOR ART
Figure 18A:
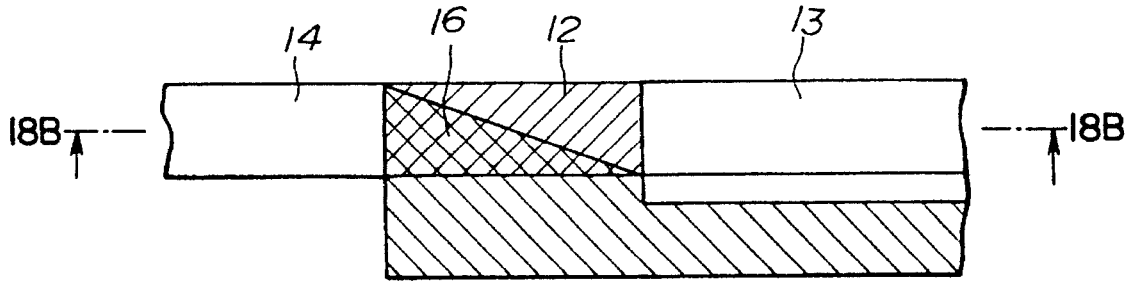
FIGS. 18A and 18B show a second embodiment of the present invention.
Figure 18B:
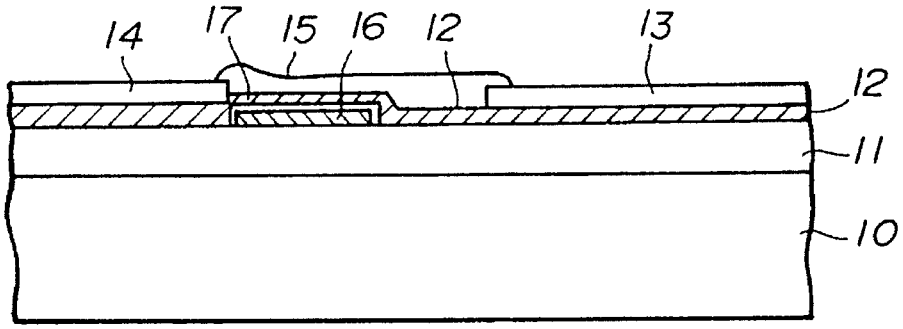

FIGS. 18A and 18B show a second embodiment of the present invention. In FIGS. 18A and 18B, those parts which are the same as those shown in FIGS. 14A and 4B are given the same reference numbers. Referring to FIGS. 18A and 18B, the radiator 16 is formed on the heat reserve layer 11 and under the heater element layer 12.

Figure 19A:
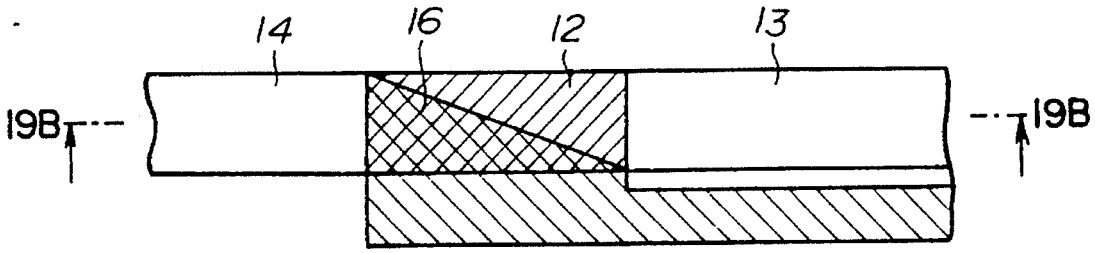
FIGS. 19A and 19B show a third embodiment of the present invention.
Figure 19B:
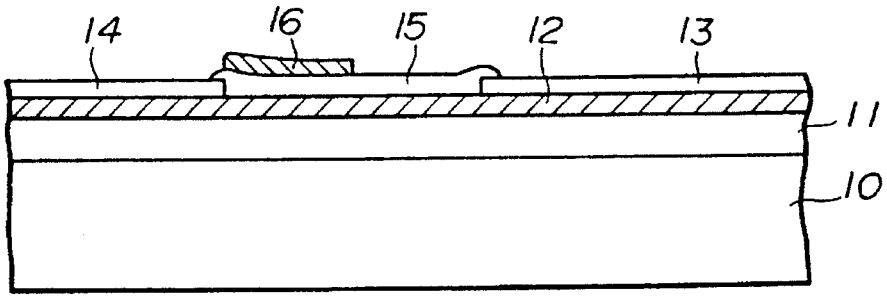

FIGS. 19A and 19B shows a third embodiment of the present invention. In FIGS. 19A and 19B, those parts which are the same as those shown in FIGS. 14A and 14B are given the same reference numbers. Referring to FIGS. 19A and 19B, the radiator layer 16 is formed on the protection layer 15.

Figure 20:
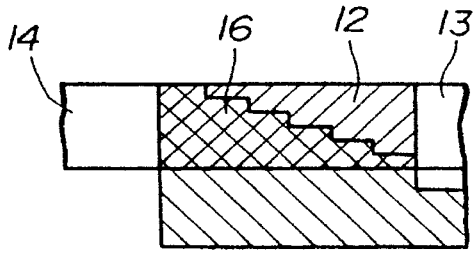
FIGS. 20 and 21 show modifications of the patterns of the radiator layer.
Figure 21:
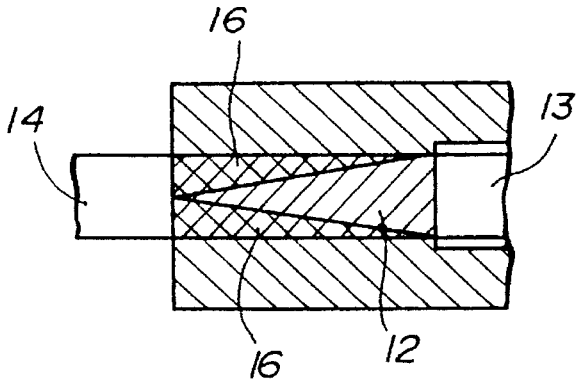

FIGS. 20 and 21 show modifications of patterns of radiator layer 16. Referring to FIG. 20, an edge of the radiator layer 16 on the heater element layer 12 is formed in a stairs-shape. The width of the radiator layer 16 on the heater element layer 12 increases by a step in the current flow direction. In this case, a cost for production of a photo mask used for forming the radiator layer 16 decreases. Referring to FIG. 21, two radiator layers 16 are formed on the heater element layer 12. The radiator layers 16 are arranged so as to be symmetric to the center line of the heater element in the current flow direction. The width of each of the radiator layers 16 increases in the current flow direction. In this case, the bubble is symmetrically generated to the current flow direction.

There are omitted parts in the embodiments described above in order to prevents the figures from becoming complicated. For example, in FIGS. 14B, 15, 18B and 19B, a protection layer is desirably formed on the electrodes 13 and 14 so that the electrodes 13 and 14 are not in contact with the ink. In addition, in the case where the radiator layer 16 is made of a material which is corroded by the ink with ease, a protection layer is formed on the radiator layer 16. In FIGS. 14A, 18A, 19A, 20, 21 and 22A, a protection film formed on the heater element layer 12 is omitted. The protection film is actually formed on the heater element layer 12.

A description will now be given of a production process of the bubble jet recording head shown in FIGS. 14A and 14B.

A silicon wafer which is the base 10 is oxidized by heating so that a $SiO_2$ film is grown to 2 μm on the surface of the silicon wafer. The $SiO_2$ is the heat reserve layer 11. A layer of $HfB_2$ is formed on the heat reserve layer 11 by a spattering process as the heater element layer 12. A thickness of the layer of $HfB_2$ is, for example, 2200 Å. A layer of Al is formed on the heater element layer 12 by a evaporation process as the radiator layer 16. A thickness of the layer of Al is, for example, 800 Å. Next, Au is deposited by evaporation on the heater element layer 12 as electrodes 13 and 14. A thickness of each of electrodes 13 and 14 is, for example, 10000 Å. At this time, a $SiO_2$ layer has been formed on the heater element layer 12 as the isolation layer 17 so that the radiator layer made of Al is not in contact with the electrode 14 made of Au. $SiO_2$ is deposited on the heater element layer 12 and the radiator layer 16 by spattering as protection layer 15. A thickness of the protection layer made of $SiO_2$ is, for example, 9000 Å. Furthermore, Ta is deposited on the protection layer 15 made of $SiO_2$ by spattering as a cavitation-proof layer.

In the process in which a plurality of layers are formed, well known techniques such as photolithography and photoetching are used. Finally, the heater element layer 12 is, for example, a rectangle of 24 μm×80 μm . The width of each electrode is equal to the length of shorter side of the heater element layer 12. That is, the width of the electrode is, for example, 24 μm.

A description will now be given of a fourth embodiment of the present invention with reference to FIGS. 22A and 22B.

Figure 22A:
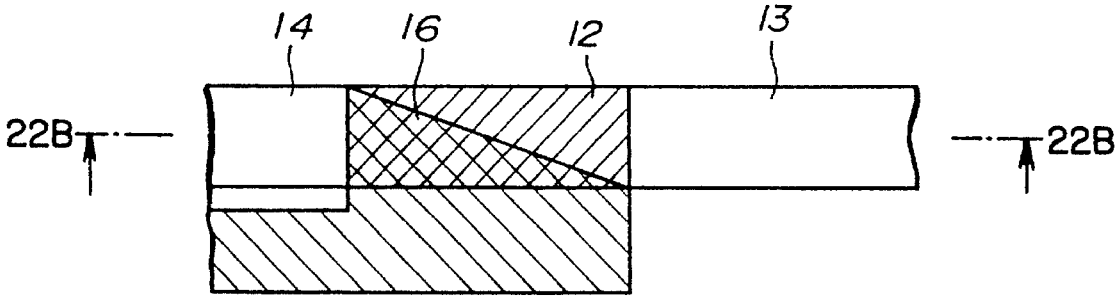
FIGS. 22A and 22B show a fourth embodiment of the present invention.
Figure 22B:
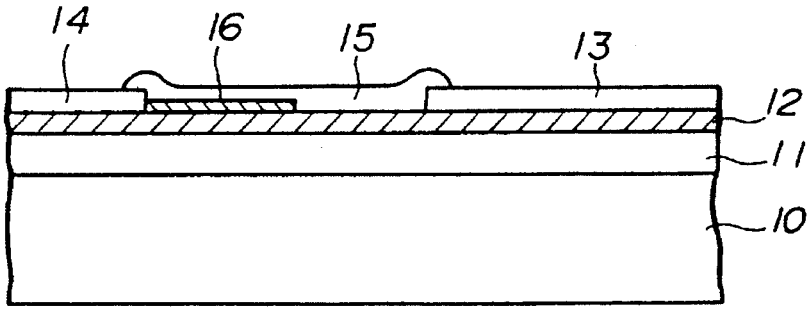

Referring to FIGS. 22A and 22B, there is no insulator layer of $SiO_2$ which is provided between the radiator layer 16 and earth electrode 14, and so the radiator layer 16 is in contact with the earth electrode 14. Thus, the radiator layer 16 also has a function of earth electrode. The plane shape of the heating part of the heater element layer 12 is not rectangle and is right angled triangle as shown in FIG. 22A. The amount of heat generated from the heater element layer 12 gradually increases in the current flow direction (from the controlling electrode 13 to the earth electrode 14). That is, there is a thermal gradient in the heat generated from the heater element layer 12. Thus, in this case, a thermal gradient of the radiator layer 16 and a thermal gradient of the heater element layer 12 are generated.

The radiator 16 and the earth electrode 14 are independently formed in the embodiments described above. However, in the embodiment shown in FIGS. 22A and 22B, it is possible to integrally form the the radiator layer 16 and the earth electrode 14 at the same time.

Figure 23:
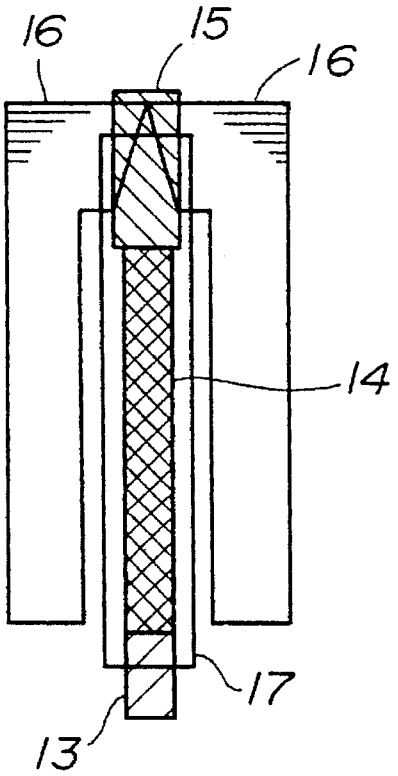
FIG. 23 shows a fifth embodiment of the present invention.

FIG. 23 shows a fifth embodiment of the present invention. In FIG. 23, the controlling electrode 13, the insulation layer 17 and the earth electrode 14 are stacked on the base so that the insulation layer 17 is sandwiched between the controlling electrode 13 and the earth electrode 14. The controlling electrode 13 and earth electrode 14 are connected to the heater element layer, and the radiator layer 16 is provided on the heater element layer. A part of the radiator layer 16 on the heater element layer is covered by the protection layer 15. The structure as described above is termed the laminated electrodes structure. Because of this laminated electrodes structure, it is possible to arrange the heater elements at high density such as 16 dot/mm.

A description will now be given of the heater part having the general laminated electrodes structure with reference to FIG. 24 and 25.

Figure 24:
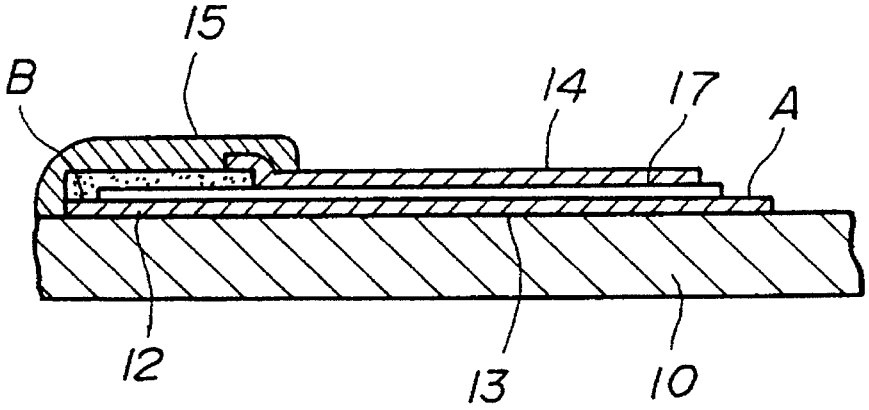
FIGS. 24 and 25*a*–25*e* show the heater part having the general laminated electrode structure.
Figure 25A:
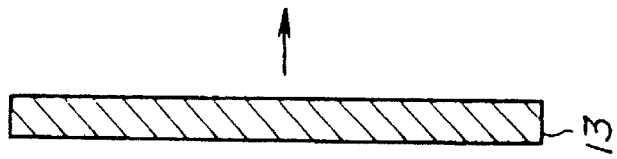
Figure 25B:
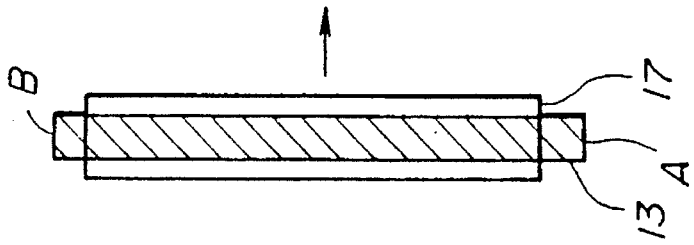
Figure 25C:
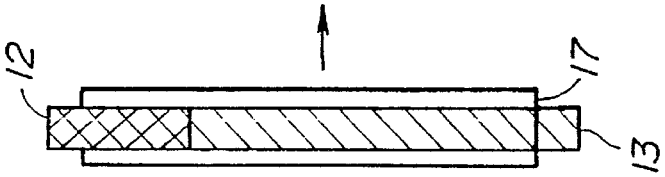
Figure 25D:
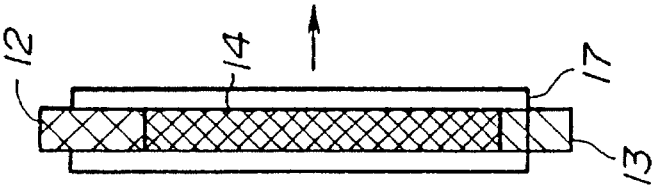
Figure 25E:
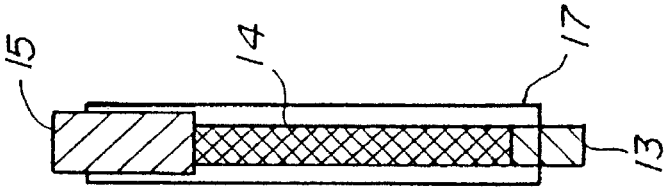

In FIG. 24, the heater part has a base 10, a heater resistance layer 12, a first electrode 13, a second electrode 14, a protection layer 15 which protects the heater resistance layer 12 against the ink and a insulation layer 17. A lead line is connected to an end (A) of the first electrode 13, and an end (B) of the first electrode 13 is connected to the heater resistance layer 12.

The heater part shown in FIG. 24 is produced in accordance with a procedure shown in FIG. 25.

(25A) The first electrode 13 is formed on the base 10.

(25B) The insulation layer 17 is formed on the first electrode 13 so that a part of the first electrode 13 other than the part (A) connected to the lead line and the part (B) connected to the heater resistance layer 12 is covered by the insulation layer 17.

(25C) The heater resistance layer 12 is formed on the insulation layer 17 and on the first electrode 13. Then the heater resistance layer 12 is electrically connected to the part (B) of the first electrode 13.

(25D) The second electrode 14 is formed on the insulation layer 17 so as to be connected to an end of the heater resistance layer 12 opposite to an end connected to the part (B) of the first electrode 13.

(25E) The protection layer 15 is formed on the heater resistance layer 12. The protection layer 15 protects the heater resistance layer 12 against the ink.

In addition, a protection layer protecting the second electrode 14 against the ink is provided on the second electrode 14 and a cavitation proof protection layer is provided, if needed. However, the protection layer and the cavitation proof protection layer are omitted in FIG. 24 and 25 in order to simply describe.

In FIG. 23, the heater part produced in accordance with the procedure described above and shown in FIG. 25 is provided with the radiator layer 16.

FIG. 26 shows an embodiment of the production process of the heater part, and FIG. 27 is a cross sectional view taken line along 27—27 in FIG. 26(g) which illustrates the completed heater part. In FIG. 27, the heater part has a Si wafer, a heater element layer 91, a first electrode 92, a insulation layer 93, a second layer 94, a heat insulation layer 95, a cavitation proof layer 96, an electrode protection layer 97 and a bonding pad 98.

In FIG. 26, a part which has slanting lines indicates a part which is formed in the process.

Referring to FIG. 26;

(26A) $SiO_2$ films is formed on the surface of the Si wafer by heat oxide and so one. The heater element layer 91 is formed by spattering on $SiO_2$ film of the Si wafer. The heater element layer 91 is made of $HfB_2$. The thickness of the heater element 91 is 3000 Å.

(26B) Al is deposited on the $SiO_2$ film by spattering so that the first electrode 92 made of Al is formed. The thickness of the first electrode is 10000 Å.

(26C) The insulation layer 93 made of $SiO_2$ is formed by spattering so that a contact part 91*a* of the heater element layer 91 and the bonding pad 98 of the first electrode 92 are exposed. The contact part 91*a* is in contact with the second electrode 94 as will be describe later. The thickness of the insulation layer is 8000 Å.

(26D) The second electrode 94 made of Al is formed on the insulation layer 93 so as to be in contact with the contact part 91*a* of the heater element layer 91 by spattering. The thickness of the second electrode 94 is 10000 Å. The second electrode 94 also has a function of a radiator. On the insulation layer 93 corresponding to the heater element layer 91, an area of the second electrode 94 gradually increases in the direction going the first electrode 92 to the contact part 91*a* of the heater element layer 91. The direction going the first electrode 92 to the contact part 91*a* of the heater element layer 91 corresponds to the current flow direction. Thus, there is the thermal gradient in the heat transmitted from the heater element layer 91 to the ink. Al is suitable for use as a material of the electrode, and the heat conductivity of Al is large so that it is also suitable for use as the radiator layer.

(26E) The heat insulation layer 95 made of $SiO_2$ is formed on the insulation layer 93 and the second electrode layer 94 by spattering. The thickness of the heat insulation layer 95 is 5000 Å.

The second electrode 94 which also functions as the radiator and the cavitation proof layer 96 as will describe later are thermally isolated by the heat insulation layer 95 with each other. Thus, the second electrode 94 effectively functions as the radiator.

(26F) The cavitation proof layer made of Ta is formed on the heat insulation layer 95 by spattering. The thickness of the cavitation proof layer 96 is 3000 Å. A impulse force which is generated when the bubble is disappeared is softened by the cavitation proof layer 96 so that the heating part is prevented from damaging and the life of the recording head becomes long.

(26G) The electrode protection layer 97 made of the Photoneece (manufactured by Toray Inc). in Jpan is formed on the first electrode 92 and the second electrode 94. The thickness of the electrode protection layer 97 is 12000 521 .

FIG. 28 shows another embodiment of production process of the heater part, and FIG. 29 is a cross sectional view taken line along 29—29 in FIG. 29 (28G) which illustrates the completed heater part. In FIG. 29, the heater part has a Si wafer, a first electrode 101, a insulation layer 102, a heater element layer 103, a second layer 104, a heat protection layer 105, a cavitation proof layer 106, an electrode protection layer 107 and a bonding pad 108. In FIG. 26, a part which has slanting lines indicates a part which is formed in the process.

Referring to FIG. 28;

(28A) $SiO_2$ film is formed on the surface of the Si wafer by heat oxide and so on. The first electrode 101 made of Al is formed on the $SiO_2$ film of the Si wafer by spattering. The thickness of the first electrode 101 is 10000 Å. The first electrode 101 also has a function of a radiator. Under the heater element layer 103 as will be described later, an area the first electrode 101 gradually increases in the current flow direction. Thus, there is the thermal gradient in the heat transmitted from the heater element layer 103 to the ink.

(28B) The insulation layer 102 made of $SiO_2$ is formed on the first electrode by spattering so that a contact part 101*a* of the first electrode 101 and the bonding pad 108 of the first electrode 101 are exposed. The thickness of the insulation layer 102 8000 Å. The contact part 101*a* of the first electrode is in contact with the heater element layer 103 as will be described later.

(28C) The heater element 103 made of $HfB_2$ is formed on the insulation layer 102 so as to be in contact with the contact part 101*a* of the first electrode 101 by spattering. The thickness of the heater element 103 is 3000 Å.

(28D) The second electrode 104 made of Al is formed on the insulator layer 102 so as to be in contact with the heater element layer 103 by spattering. The thickness of the second electrode 104 is 10000 Å.

(28E) The heat protection layer 105 made of $SiO_2$ is formed on heater element layer 103 by spattering. The thickness of the heat protection layer 105 is 10000 Å. The heat protection layer 105 mainly prevents the heater element layer 103 from being chemically corroded by the ink. Thus, it is desirable that the thickness of the heat protection layer 105 is large as possible in order to decrease defects such as pin holes. On the other hand, it is desirable that the thickness of the heat protection layer 105 is small as possible in point of views of the thermal conduction efficiency and the thermal stress. As a result, in this embodiment, the thickness of the heat protection layer 105 is determined at 10000 Å.

(28F) The cavitation proof layer 106 made of Ta is formed on the heat protection layer 105 by spattering. The thickness of the cavitation proof layer 106 is 3000 Å. An impulse force which is generated when the bubble is disappeared is softened by the cavitation proof layer 106 so that the heating part is prevented from damaging and the life of the recording head becomes long.

(28G) The electrode protection layer 107 made of the Photoneece (manufactured by Toray Inc). in Japan is formed on the first electrode 101 and the second electrode 104.

In the production process shown in FIG. 26 and FIG. 28, each layer is formed by spattering, and then photolithography using the positive type photoresist OFPR (manufactured by Tokyo Ohka Inc.) and etching are respectively performed.

Figure 1:
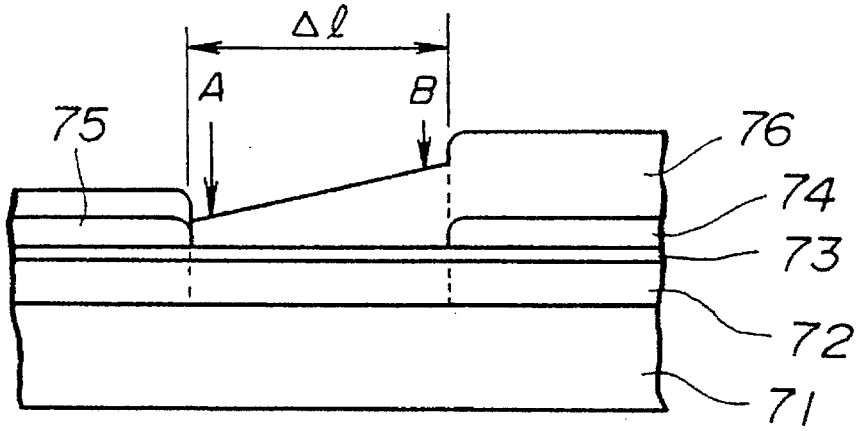
FIG. 1 PRIOR ART
FIGS. 1 through 8 illustrate the structures of heater portions applied to the conventional liquid jet recording system.
Figure 2:
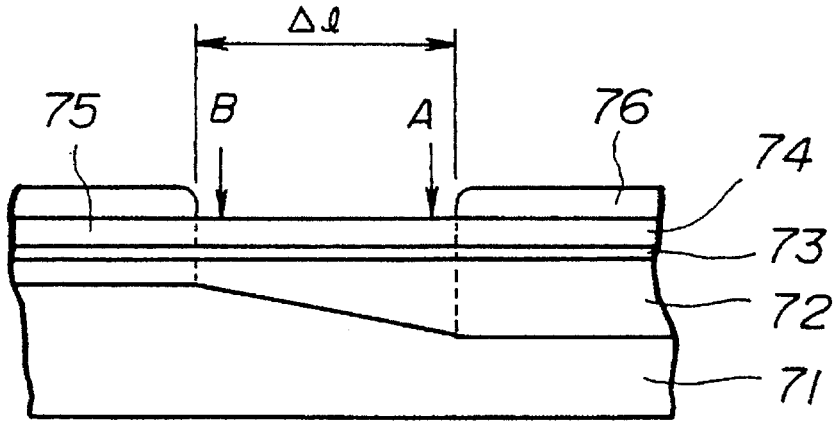
FIG. 2 PRIOR ART
Figure 3:
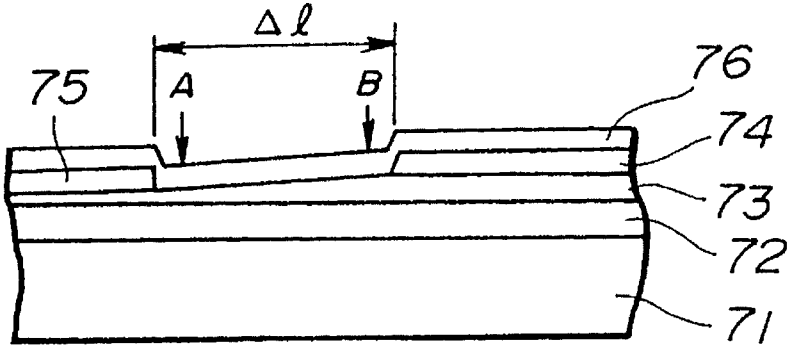
FIG. 3 PRIOR ART
Figures 1, 30A:
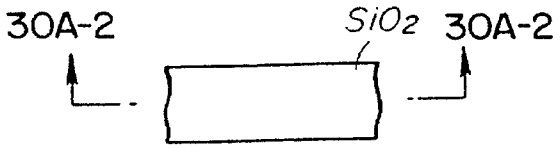
FIGS. 30A through 30N show the production process of the bubble jet recording head.
Figures 2, 30A:
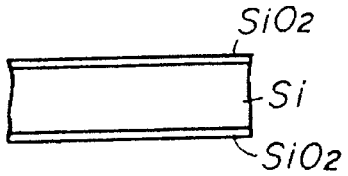

A description will now be given of the production process of the bubble jet recording head with reference to FIGS. 30A through 30N. In each of FIGS. 30A through 30N, FIG.30A-1 is a plane view and 30A-2 is a cross sectional view taken along line 30A-2 30A-2 shown in FIG. 30A-1, for example (A) $SiO_2$ film is grown on the Si wafer by heat oxide so that the thickness of the $SiO_2$ film is in a range of 1 μm to 2 μm (refer to FIG. 30A)

Figures 1, 30B:
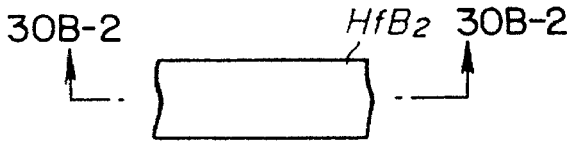
Figures 2, 30B:
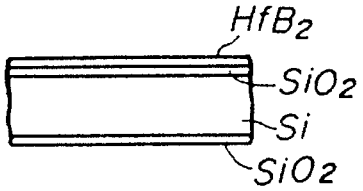

(B) $HfB_2$ which is a material for the heater element is deposited on the $SiO_2$ film by spattering (refer to FIG. 30B).

Figures 1, 30C:
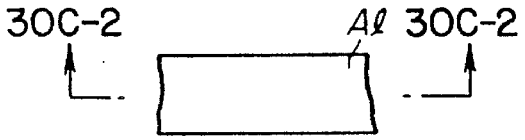
Figures 2, 30C:
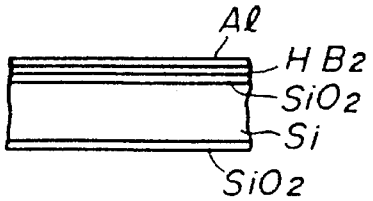

(C) Al which is a material for the first electrode is deposited on the $HfB_2$ layer by spattering (refer to FIG. 30C).

Figures 1, 30D:
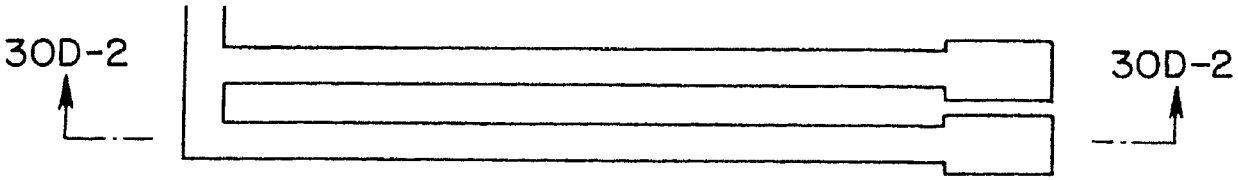
Figures 2, 30D:
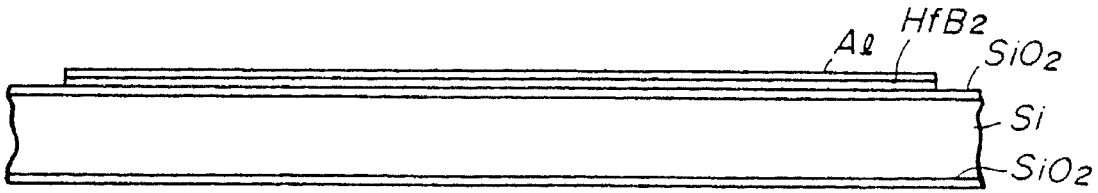

(D) The Al layer is shaped into a pattern of lead electrodes by photolithography and etching (refer to FIG. 30D). For the sake of simplicity, FIG. 30D (a) shows two elements. This holds true for the FIG. 30E through FIG. 30N.

Figures 1, 30E:
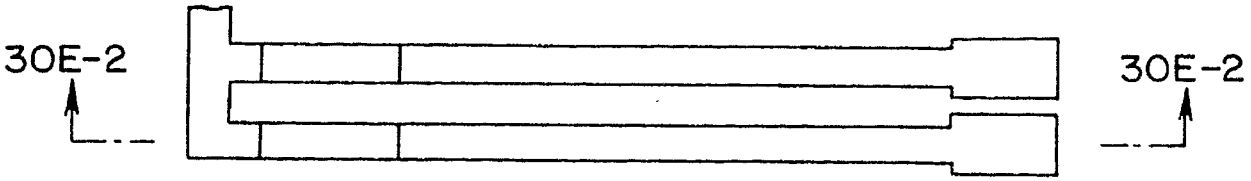
Figures 2, 30E:
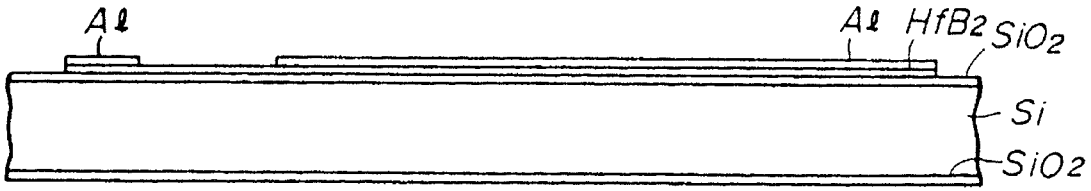

(E) Al on the heater element made of $HfB_2$ is removed by photolithography and etching so that the heater element made of $HfB_2$ is exposed (refer to FIG. 30E).

Figures 1, 30F:
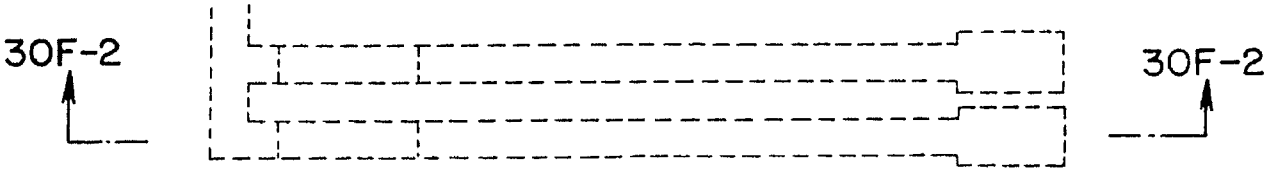
Figures 2, 30F:
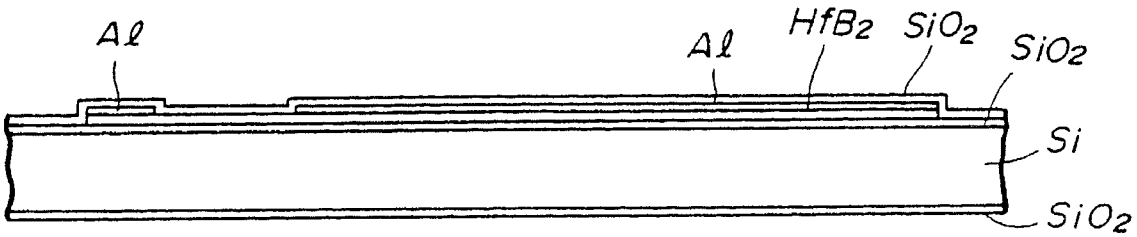

(F) $SiO_2$ is deposited on an exposed surface by spattering so that the insulation layer is formed (refer to FIG. 30F).

Figures 1, 30G:
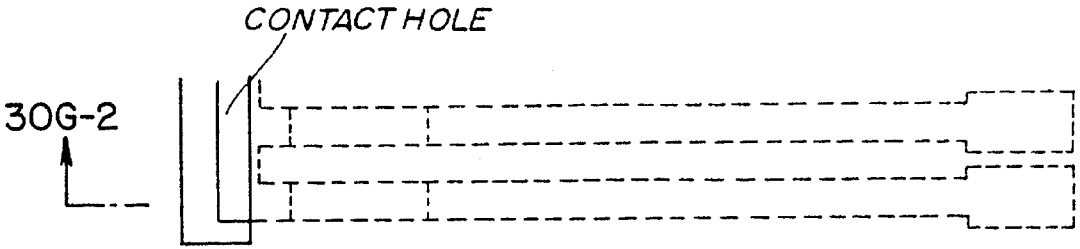
Figures 2, 30G:
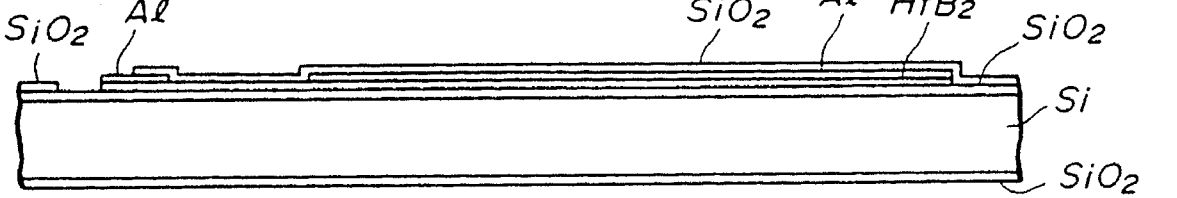

(G) In order to form contact holes, $SiO_2$ is removed at a predetermined part (refer to FIG. 30G).

Figures 1, 30H:
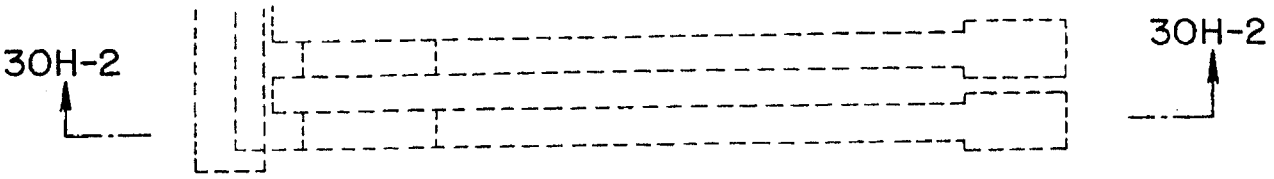
Figures 2, 30H:
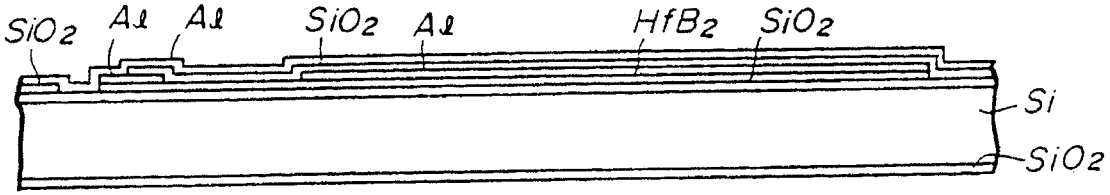

(H) Al which is a material for the second electrode is deposited on an exposed surface by spattering (refer to FIG. 30H).

Figures 1, 30I:
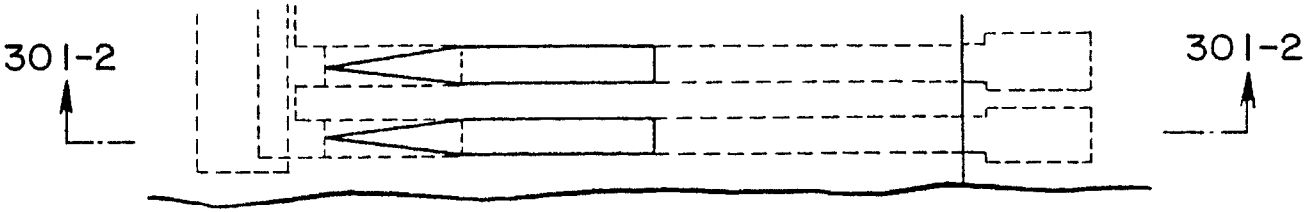
Figures 2, 30I:
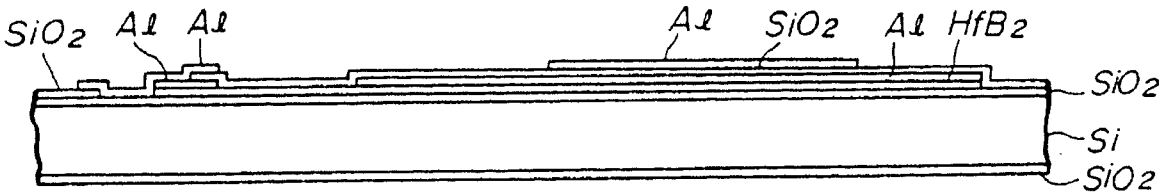

(I) Al on the heater element, a part of the lead electrode and a bonding pad is removed by photolithography and etching (refer to FIG. 30I). Since Al layer for the second electrode also has a function of a radiator, Al on the heater element made of $HfB_2$ is removed so that the area of Al covered the heater element gradually changes. In order to form an orifice an end part of a stacked structure finally obtained is cut, as will described later (refer to FIG. 30N). Therefor, Al on the end part of a stacked structure as shown in FIG. 30 (I) is removed so as to not expose when the end part of the stacked structure is cut.

Figures 1, 2, 30J, 30K:
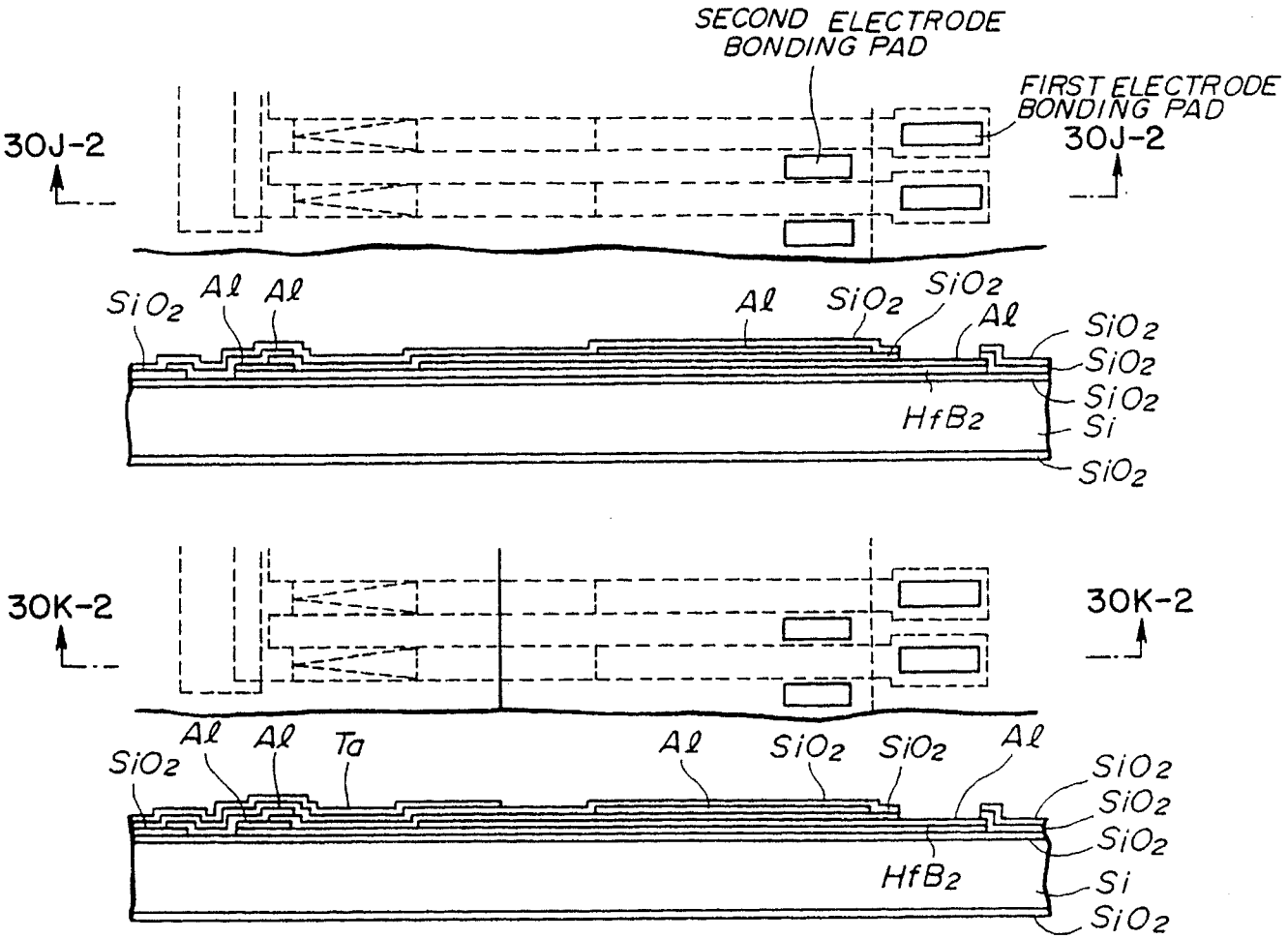

(J) $SiO_2$ is deposited on an exposed surface of the stacked structure obtained by the last process, as shown in FIG. 30 (I) by spattering so that the heat insulation layer and the protection layer (refer to FIG. 30J). Then, $SiO_2$ on the bonding pad is removed by photolithography and etching.

(K) Ta is deposited on the $SiO_2$ layer by spattering (refer to FIG. 30K). Then, Ta is removed so as to only cover on an adjacent to the heater element. Thus the cavitation layer is formed on the $SiO_2$ layer.

Figures 1, 30L:
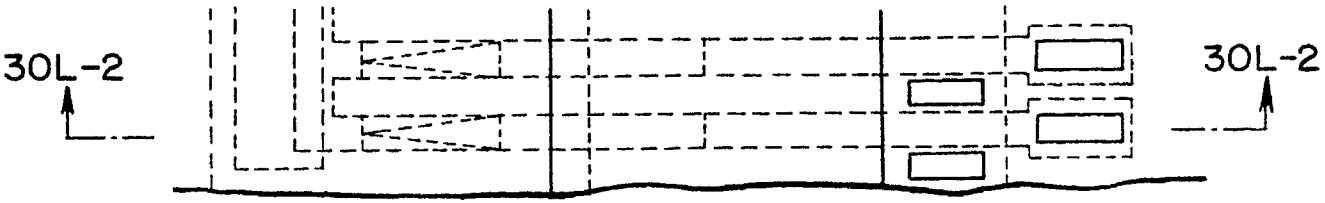
Figures 2, 30L:
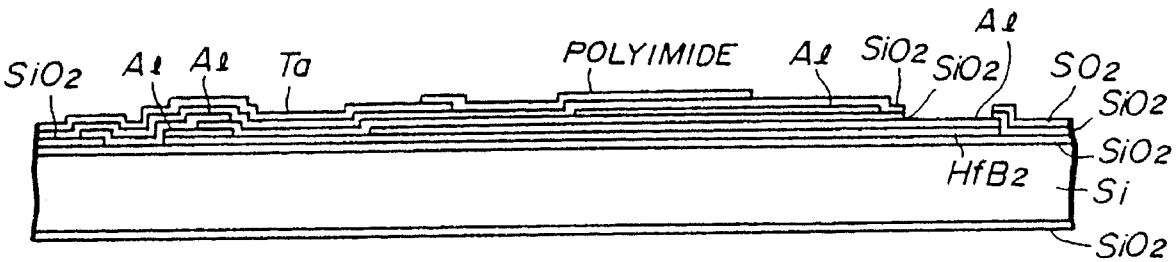

(L) A polyimide layer is formed on the heat insulation layer ($SiO_2$) as a protection layer of lead electrodes (refer to FIG. 30L).

Figures 1, 30M:
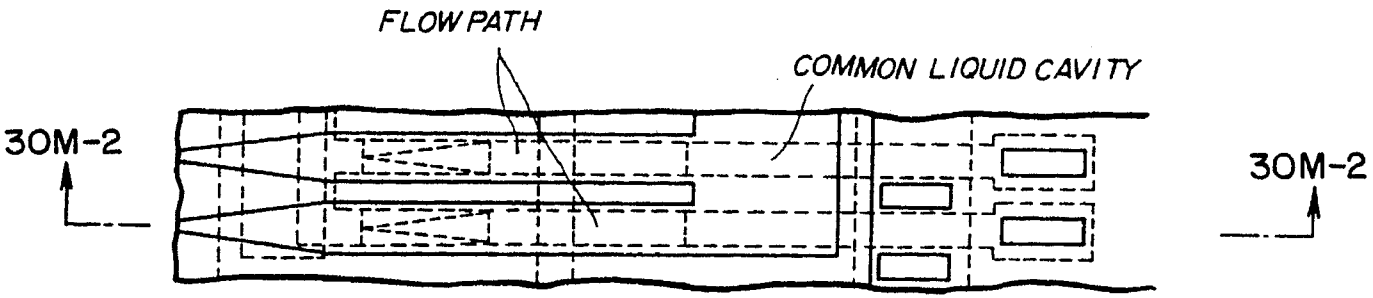
Figures 2, 30M:
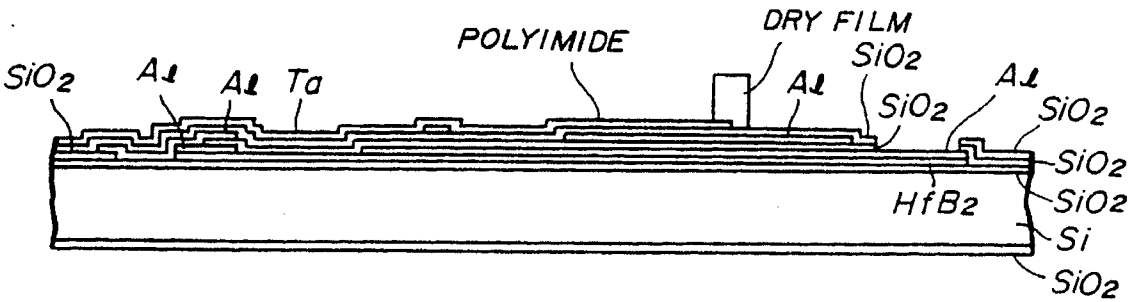
Figures 1, 30N:
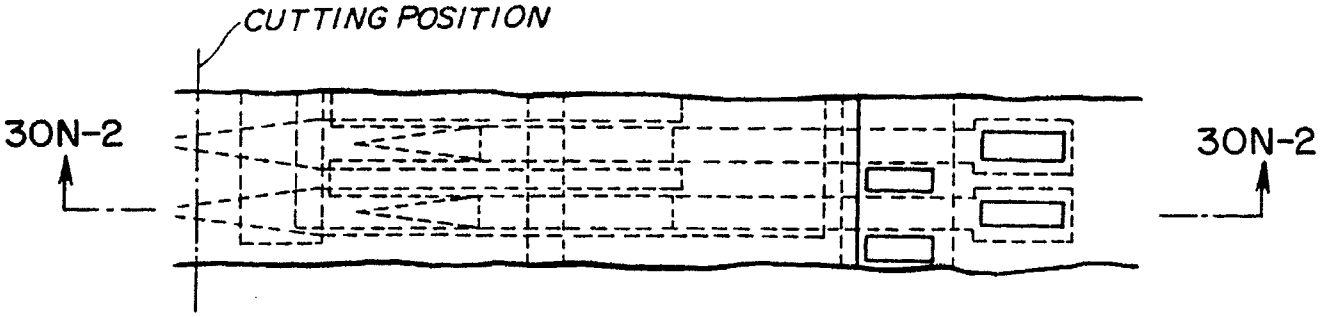
Figures 2, 30N:
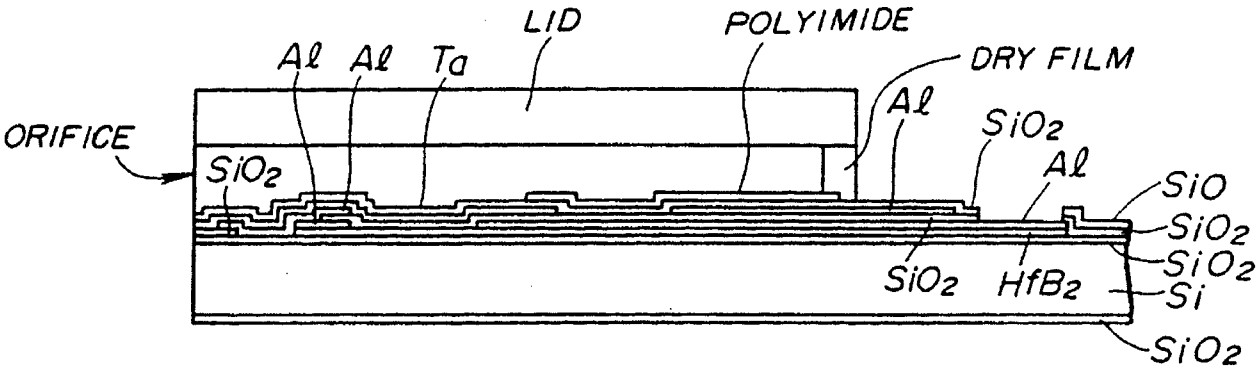

(M) A dry film photoresist is laminated on the stacked structure obtained by the last process (L) (refer to FIG. 30M). Then flow paths are formed in the laminated dry film photoresist by photolithography. In this case, each of flow paths is formed so that an orifice is positioned at a left end of the stucked structure in FIG. 30M. Thus, the area of the second electrode (Al) having the function of the radiator on the heater element increases toward the orifice.

(N) A lid plate is fixed on the dry film in which flow paths are formed (refer to FIG. 30N).

The end of the stacked structure is cut so that an orifice corresponding to one of flow paths is formed.

Figure 31:
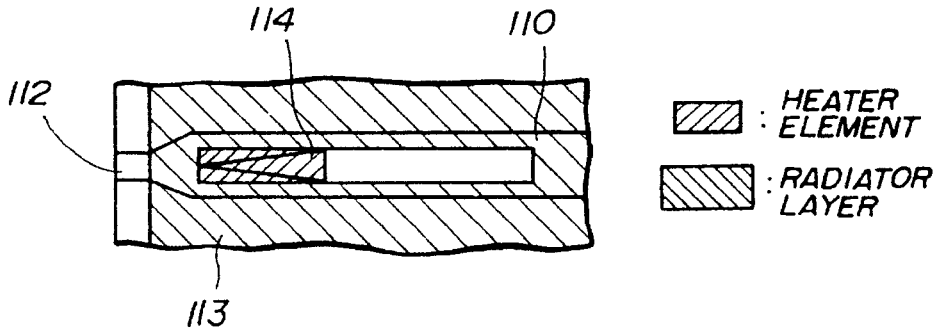
FIG. 31 is a plan view illustrating an example of the bubble jet recording head.

FIG. 31 shows the heater element 114 having a rectangular shape, the radiator layer 113 which is provided an upper side of the heater element 114 (or a lower side of the heater element 114, an ink flow path 110 and an orifice 112.

Figure 32A:
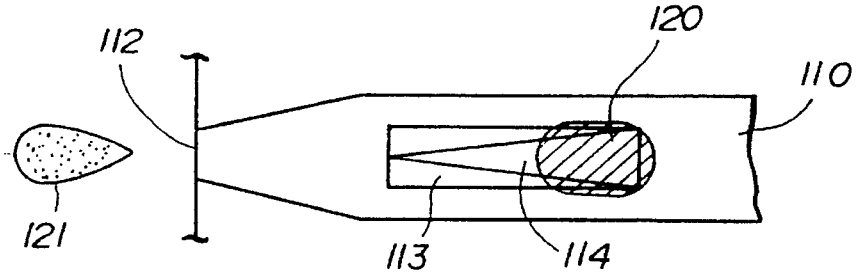
FIG. 32A–32C shows a state where the amount of the ink jetted from the orifice changes.

FIG. 32 shows a state where the amount of ink jetted from the orifice changes. When the input power supplied to the heater element is large the amount of the jetted ink is as shown in FIG. 32 (*a*).

Figure 32B:
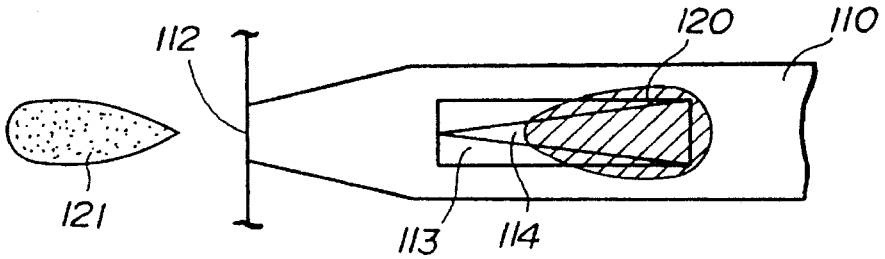
Figure 32C:
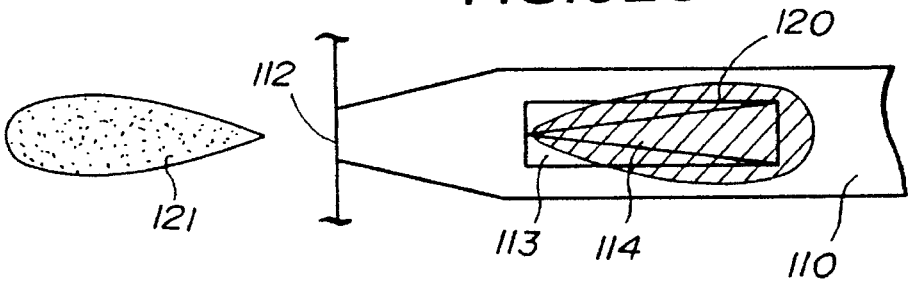

When the input power supplied to the heater element is medium the amount of the jetted ink is as shown in FIG. 32 (*b*). When the input power supplied to the heater element is small the amount of the jetted ink is as shown in FIG. 32 (*c*). The amount of heat absorbed by the radiator layer 113 increase toward the orifice 112. When the input power supplied to the heater element 114 is small, at near the orifice 112, heat generated from the heater element 114 is absorbed to the radiator layer 113 in a moment so that a region where the film boiling occurs is far from the orifice 112 and small. Thus, the bubble 120 is generated at far from the orifice 112 and is small,as shown in FIG. 32 (*a*). As a result, the ink droplet 121 is small so that a small dot is formed on the recording sheet. When the input power supplied to the heater element 114 increases, the amount of heat generated from the heater element 114 increases so that the region where the film boiling occurs extends toward the orifice 112 in accordance with the input power, as shown in FIGS. 32B and 32C. That is, the region, where the temperature is equal to or greater than the critical temperature for which the film boiling occurs, extends toward the orifice 112. Because of this, the bubble 120 grows toward the orifice 112 so as to push the ink toward the orifice 112.

In the bubble jet recording head having the structure described above, for example, when the input pulse voltage supplied to the heater element changes in a range of 18v to 40v, the size (the length) of the bubble generated on the heater element changes in a range of 15 μm to 110 μm.

Then, the amount of the jetted ink droplet changes in accordance with changing the size of the bubble so that a diameter of pixel on the recording sheet changes in a rage of 50 μm to 120 μm. In this case, the width of the pulse voltage supplied to the heater element is 6 μsec..

The recording head described above is generally called edge shooter type. On the other hand, there is the bubble jet recording head called a side shooter type. A description will now be given of the bubble jet recording head of the side shooter type.

FIG. 33 is a partially sectional perspective view illustrating a basic structure of bubble jet recording head of the side shooter type.

Referring to FIG. 33, a heater element 129 is provided on the heater base 122, and a flow path 125 corresponding to the heater element 129 is formed in the lid base 121. The flow path 125 is formed in a direction perpendicular to the surface of the heater element 129. A end of the flow path 125 opens, and the opening of the flow path 125 faces the heat element 129. At another end of the flow path 125, an orifice 124 is formed. Due to a bubble generated on the heater element 129, an ink droplet 132 is jetted from the orifice 124 in the direction perpendicular to the surface of the heater element 129.

FIG. 34 shows a principle of generating the ink droplet. FIGS. 34A–34E respectively correspond to FIGS. 11A, 11C, 11D, 11F, and 11G. That is, when a heat impulse is generated from the heater element 129, the bubble successively grows in order of FIGS. 34A–34B, and FIG. 34*c*. Due to the growth of the bubble 131, the ink droplet is jetted from the orifice as shown in FIG. 34 (*d*), and then the bubble is disappeared so that a state of the ink on the heater element return to the initial state as shown in FIG. 34 (*e*).

In the bubble jet recording head of the side shooter type, the orifice is provided at a position opposite to the heater element. The ink droplet flies in the direction in which the bubble grows. Therefor, a pressure for pushing the ink generated due to the growth of the bubble effectively transmits to the ink. The side shooter type is superior to the edge shooter in view of energy consumption. A radiator is formed on the heater element in the side shooter type so that the thermal gradient is generated in the ink on the heater element. As a result, it is possible to provide a recording head in which the energy consumption is small and be capable of recording a gradational image.

A description will now be given of a embodiment of a bubble jet recording head of side shooter type according to the present invention with reference to FIGS. 35A through 35C.

Figure 35A:
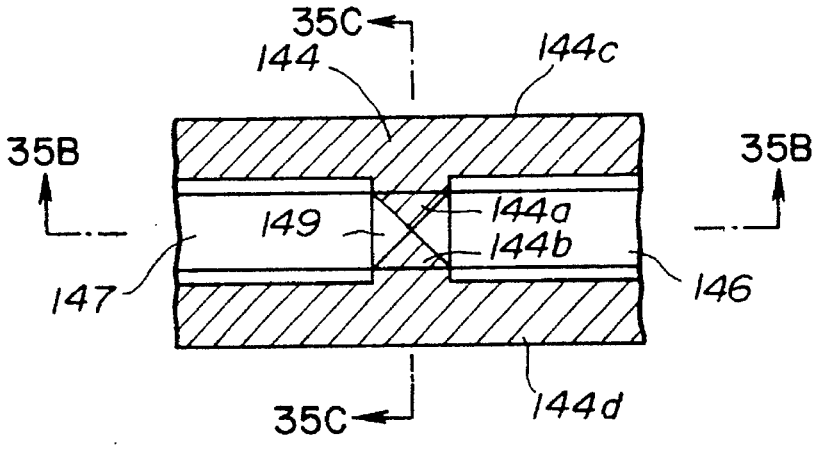
FIGS. 35A through 35C show an embodiment of the bubble jet recording head of the side shooter type.

FIG. 35A is a plan view illustrating an essential part of the recording head. FIG. 35B is a cross sectional view taken along line 35B—35B in FIG. 35A. FIG. 35C is a cross sectional view taken along line 35C—35C in FIG. 35A. For the sake of the simplicity, the orifice is omitted and only the heater base is illustrated in FIGS. 35A though 35C.

The heater base has a base 140, heat reserve 141, a heater element layer 142, a radiator protection layer 143, a radiator layer 144, a protection layer 145, a controlling electrode 146, and an earth electrode 147. The heater base having the structure described above is produced as follows.

A $SiO_2$ film is grown to 1.5 μm on a surface of a silicon wafer which is base 140. This $SiO_2$ is the heat reserve layer 141. $HfB_2$ deposited on the heat reserve layer 141 by spattering so that the heater element layer 142 is formed on the heat reserve layer 141. The thickness of the heater element layer 142 is 2500 Å. Al is deposited on the heat reserve layer 141 and the heat element layer 142 by spattering. The width of the Al layer is 1.2 μm. The Al layer is used as electrode layer. Due to two times of processes of photolithography and etching, a pattern of two laminated structure having the heater element layer 142 and the electrode layer, and a part of the electrode layer positioned at a heater part 148 is removed so that a square-shaped heater element 149 is exposed. Thus, the controlling electrode 146 and the earth electrode 147 are formed on the heater element layer 142. When a pulse voltage is supplied between the controlling electrode 146 and the earth electrode 147 the heater element 149 generates Joule heat. In order to prevent the both electrodes 146 and 147 from shorting and corroding, $SiO_2$ is deposited on the entire surface of the stacked structure by spattering. The $SiO_2$ layer is the protection layer 145, and the thickness of the protection layer 145 is 1 μm. Furthermore, the radiator layer 144 is formed on the protection layer 145. Al is deposited to 1.5 μm on the entire surface of the stacked structure by spattering. Then, the Al layer is shaped by photolithography and etching as a pattern illustrated by slant lines in FIG. 35A. That is, the radiator layer 144 has a first part 144*a*, a second part 144*b*, a third part 144*c* and fourth part 144*d*. The area of each of the first part 144*a* and the second part 144*b* increases in the direction perpendicular to the direction of arrangement of the electrodes 146 and 147 going from the center of the square-shaped heater part 48. Each of the third part 144*c* and fourth part 144*d* is in parallel with the electrodes 146 and 147. Because of the radiator layer 144 having the structure described above, heat transmitted from the heater element 149 to the ink is decreases in the direction perpendicular to the direction of arrangement of the electrodes 146 and 147 going from the center of the heater element 149. In order to prevent the radiator layer 144 made of Al from corroding, $SiO_2$ is deposited to 1 μm on the radiator layer 144 and the protection layer 143 by spattering. The $SiO_2$ layer is the radiator protection layer 143.

A description will now be give of other materials for use for the heater base having the structure described above.

Ceramics of alumina, glass or the like is used for a material making the base 140 other than silicon. Silicon in which the heat conductivity is large is the most desirable material for use as the base 140. But it is also possible to use the ceramics of alumina, the glass or the like as the base 40 in point view of cost. When the ceramics of alumina is used as the base 140, the heat reserve layer 141 is made of a material having property almost identical that of glass, as well known as the grazing layer. When the glass is used as the base 140 it is possible to form a $SiO_2$ layer by spattering. The $SiO_2$ layer becomes the heat reserve layer 141.

The heater element layer 142, the electrodes 146 and 147 and protection layer 145 are made of materials which are the same as those described in the case of the edge shooter type.

The protection layer 145 prevents heater element layer 142 from being chemically corroded by the ink. In the bubble jet recording head, when the bubble is generated and is disappeared, the cavitation force is generated. In order to physically protect the heater element layer 142 and the protection layer 145 from the cavitation force, a metal layer such as Ta layer is desirably provided in a point of view of durability. The thickness of the Ta layer is desirably in a range of 1000 Åto 5000 Å. In the case where the Ta layer as the cavitation layer is formed on the stacked structure as shown in FIGS. 35A through 35B, the Ta layer must be formed so as to not prevent the thermal gradient from being formed by the radiator layer. That is, the Ta layer is formed on the radiator protection layer 143. In this case, the Ta layer is thermally isolated from the radiator layer 144 so that there is no problem. The radiator layer is made of the material in which the heat conductivity is large. That is, the radiator layer 144 is made of Al, Ag, Au, Pt, Cu or the like.

The radiator layer is made of the same material as that of electrode so that it is possible for the radiator layer to be integrally formed with the earth electrode as will describe later.

Figure 35B:
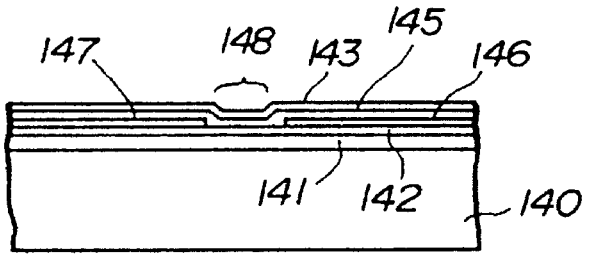
Figure 35C:
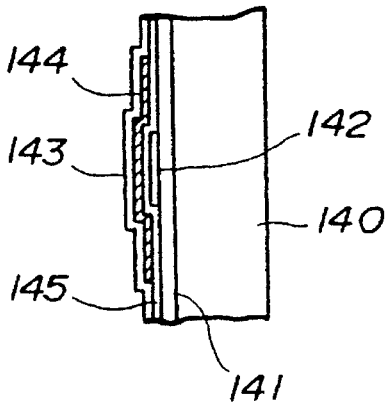

A protection layer such as polyimide layer, which is omitted in FIGS. 35A through 35C for the sake of simplicity, is formed on an area other than the heater part and the adjacent area thereof, with which the ink is in contact. The thickness of the protection layer is, for example, in a range of 1 μm to 5 μm. The protection layer (polyimide layer) mainly protects the electrodes from the recording liquid (the ink) so that the the protection layer is called the electrode protection layer. The photoneece (manufactured by Toray Inc.) is formed on the stacked structure to 1.2 μm by spin coating, and then the photoneece patterns positioned on the herter part and, adjacent area thereof and the bonding pad (not shown in FIGS. 35A through 35C) which is connected to the lead line are removed by photolithography. As a result, the electrode protection layer is formed on the stacked structure.

Figure 37:
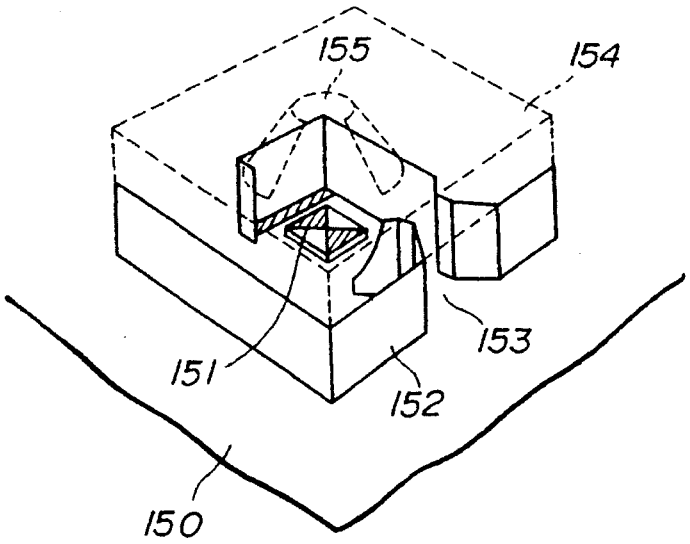
FIG. 37 shows an example of the orifice of the bubble jet recording head of the side shooter type.

In the recording head of the side shooter type described above, the ink droplet is flies in the direction substantially perpendicular to the surface of the heater element so that the orifice is formed at a position where the orifice faces the heater element. FIG. 37 shows an example of the orifice of the bubble jet recording head of the side shooter type. Referring to FIG. 37, the recording head has a heater base 150, radiator layer 151, a channel forming member 152 (for example, made of a dry film resist), a recording liquid supplying channel 153, an orifice plate 154, and an orifice 155.

The orifice 155 is formed as follows.

The recording liquid supplying channel 153 is independently formed on the heater base 150. the orifice plate 154 on which the orifice 155 is formed is connected to the recording liquid supplying channel 153. The recording liquid supplying channel 153 is formed as follows. A photosensitive resin known as the dry film photoresist is laminated on the heater base 150, and then a predetermined shaped pattern is formed by use of the exposure and the development in the photolithography technology. After then, the dry film photoresist remains on the heater base 150 as the channel forming member 152 without being removed. The thickness of the dry film photoresist is, for example, 20 μm so that the thickness (height) is the same 20 μm. The orifice plate 154 is connected on the recording liquid supplying channel 153 so that the orifice 155 faces the heater element. The orifice plate 154 is produced as follows. In this embodiment, the orifice plate is formed by use of the photoelectroforming of Ni.

The diameter of the orifice 155 formed on the orifice plate 154 is 35 μm, and the thickness thereof is 50 μm.

Figure 36A:
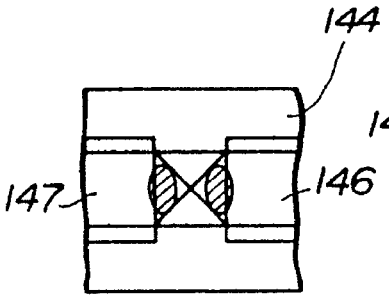
FIG. 36*a*–36*i* is a view which shows the state where the amount of the ink jetted from the orifice changes.
Figure 36B:
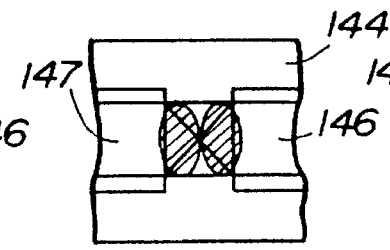
Figure 36C:
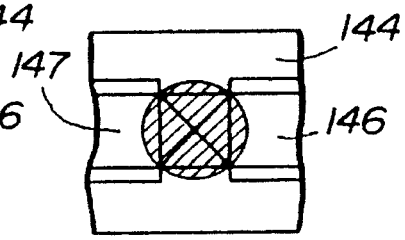
Figure 36D:
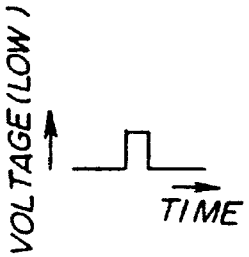
Figure 36E:
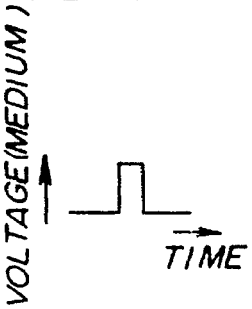
Figure 36F:
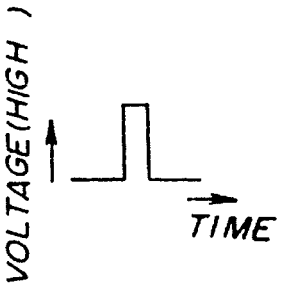
Figure 36G:
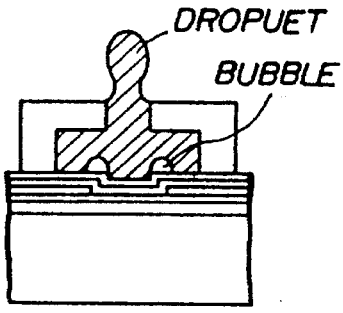
Figure 36H:
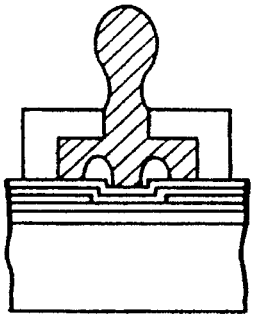
Figure 36I:
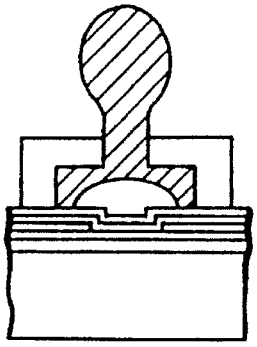

FIG. 36 is a view which shows the state where the amount of the ink jetted from the orifice is changed in the heater base as shown in FIGS. 36A through 36C. Referring to FIG. 36, when the level of the driving pulse supplied to the heat element increases from a first level corresponding to a low power (36D) through a second level corresponding to a medium power (36E) to a third level corresponding to a high power (36F)in this order, the bubbles are grown from the both sides of the heat element which are connected to the electrodes 146 and 147 as shown by areas having slant lines in FIGS. 36A and 36B Then, finally, the two grown bubbles are integrated as shown FIG. 36C. According to the growth of the bubble described above, the size of the ink jetted from the orifice increase as shown in FIGS. 36G–36I.

Figure 38A:
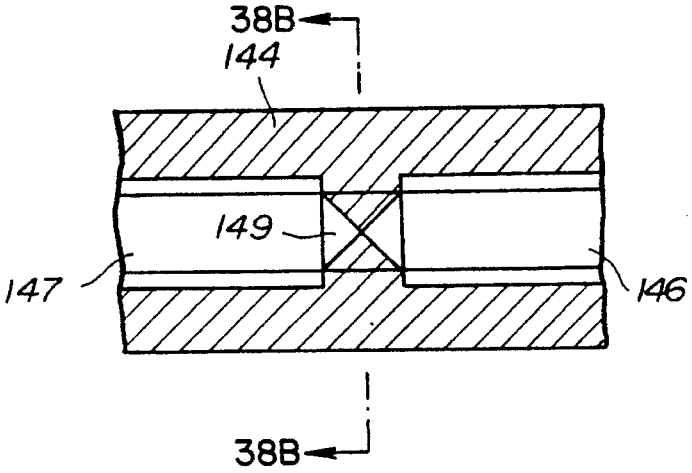
FIGS. 38A and 38B show another embodiment in which the radiator layer is formed under the heater layer.
Figure 38B:
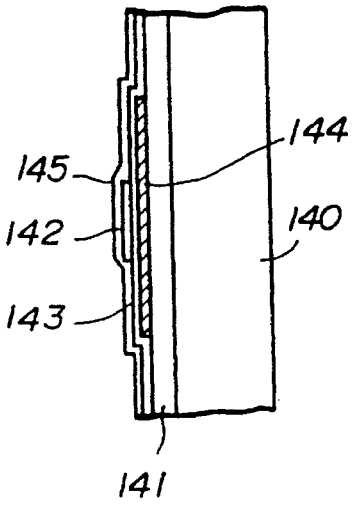
Figure 39A:
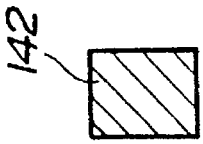
FIG. 39*a*–d shows an embodiment of a process of the heater base.
Figure 39B:
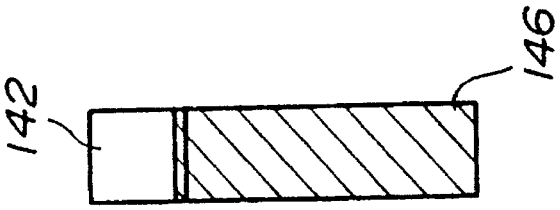
Figure 39C:
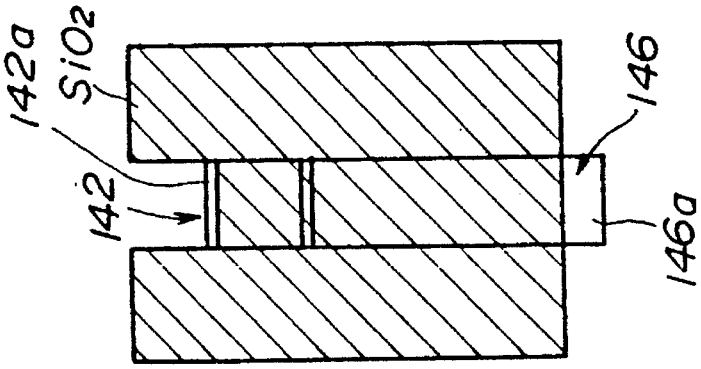
Figure 39D:
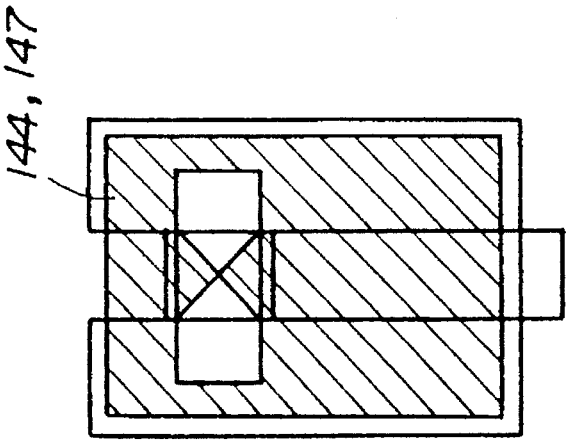

In this embodiment, the radiator layer is formed on the heater layer. Next, a description will now be given of an another embodiment in which the radiator layer is formed under the heater layer with reference to FIGS. 38A and 38B. Referring to FIGS. 38A and 38B, the heat reserve layer 141, the radiator layer 144, the radiator protection layer 143, the heater element layer 142 and the protection layer are stacked on the base 140 in this order. The radiator protection layer is also called a thermal isolation layer.

Since the radiator layer is made of a material (Al, Au and so on) identical to that of the electrode and is also made by a process (spattering, etching and so on) identical to that of the electrode, it is possible to integrate the radiator layer with the electrode. The radiator layer and the electrode are integrated with each other so that it is possible to form the pattern with ease and to decrease the cost for the production of the heater base. In addition, it is possible to prevent the life time of the heater base from shorting due to the thermal distortion in the pattern layers. A description will now be given of an embodiment of a process of the heater base in which the electrode (for example, the earth electrode) and the radiator layer are integrated with reference to FIG. 39.

Referring to FIG. 39;

(39A) Initially, the heater element layer 142 is formed on the Si wafer on which the heat oxide film is formed.

(39B) The controlling electrode 146 is formed so that an end of the controlling electrode 146 is in contact with the heater element layer 142.

(39C) An $SiO_2$ is formed on an entire surface of the stacked structure so that a connection part 142*a* of the heater element layer 142 and a bonding pad 146*a* of the controlling electrode 146 are exposed. The connection part 142*a* of the heater element layer 142 is connected to the earth electrode and a lead line is connected to the bonding pad 146*a*.

(39D) A layer which has functions of the radiator layer 144 and the earth electrode 147 is formed on the isolation layer ($SiO_2$) so that the thermal gradient occurs in the heat transmitted from the heater element layer 142 to the ink.

The protection layer, the cavitation proof layer, the electrode protection layer and so on as has been described above are stacked on the layer which has function of the radiator layer 144 and the earth electrode 147. The material, the thickness and the like of the heater base in this case are substantially identical to those of the heater base shown in FIGS. 35A through 35C.

The order of the laminated layers is changed as shown in FIGS. 38A and 38B so that it is possible to provide a heater base in which the layer having the functions of the radiator and the electrode is formed under the heater element layer.

In the case of the design and production of the bubble jet recording head, there are problems in the photolithography technique, the spattering technique and the etching technique. For example, there are a problem relating to the step coverage and a problem that a layer under the layer removed by etching is corroded by the etching process. Considering the problems as has been described above, the most suitable laminated structure, the thickness of each layer and the material of each layer and the like are determined.

Figure 40A:
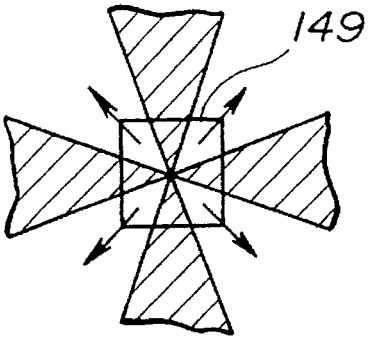
FIGS. 40A through 40E show other examples of shapes of radiator layers.
Figure 40B:
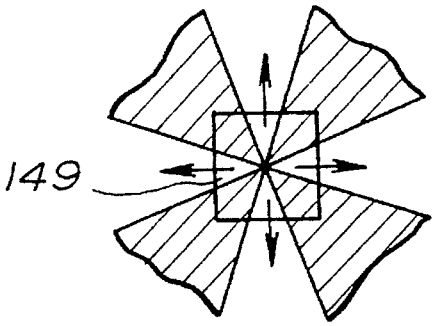
Figure 40C:
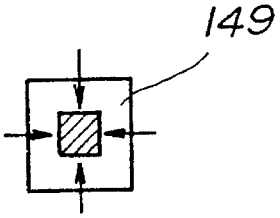
Figure 40D:
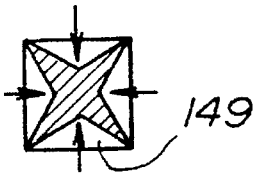
Figure 40E:
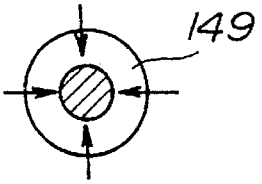

FIGS. 40A through 40D show other examples of shapes of radiator layers. In each of cases shown in FIGS. 40A through 40D, the radiator layer illustrated by slant lines is formed on or under the heater element 149 having a square shape. In the case shown in FIG. 40D, the radiator layer illustrated by slant lines is formed on or under the heater element 149 having a circle shape. In FIGS. 40A and 40B, the radiator layer is formed on or under the square-shaped heater element so as to radiately extend from the center of the heater element. In FIG. 40C, the square-shaped radiator is formed on the center of the square-shaped heater element 149. In FIG. 40D, the cross-shaped radiator layer is formed on the center of the square-shaped heater element 149. The area of the cross-shaped radiator layer decreases in a direction going from the center of the square-shaped heater element 149 to each of corners of the square-shaped heater element 149. In FIG. 40E, the circle-shaped radiator layer is formed on the center of the circle-shaped heater element 149. In each of FIGS. 40A through 40D, each of arrows indicates a direction in which the critical film boiling area is extended when the input power of the heater element increases. That is, the area on which the bubble is generated is extends in the direction shown by each of arrows when the input power of the heater element increases. In each of cases shown in FIGS. 40C through 40*e*, the heat radiation is large at the center portion of the heater element 149.

Then a radiator member connected to the radiator layer passing through the heater element 149 is formed under the heater element 149 (not shown in FIGS. 40C through 40E) so that the heat radiation effect improved.

The condition of driving the recording head having each of the structures which are shown in FIGS. 35A through 38B is indicated as follows.

| | |
|---|---|
| SIZE OF THE HEATER ELEMENT | 40 × 40 μm (30Ω) |
| DIAMETER OF ORIFICE | ϕ 35 μm |
| DRIVING VOLTAGE | 15~30 v |
| PULSE WIDTH | 3.2 μsec. |
| SUCCESSIVE RESPONSE FREQUENCY | 4.5 KHz |
| INK | ink used for BJ130 manufactured by Cannon Inc. |
| DIAMETER OF RECORDED PIXEL | 50 μm (15 v)~ 140 μm (30 v) |
| RECORDING SHEET | matted coat paper NM (manufactured by Mitubishiseishi Inc.) |

In this condition, the driving voltage is changed in a range of 15v to 30v so that the diameter of recording pixel on the recording sheet is controlled in a range of 50 μm to 140 μm. On the other hand, in the bubble jet recording head of the edge shooter type, when the driving voltage is changed in a rage of 18v to 40v (the width of the pulse is 6 μsec) the diameter of recording pixel on the recording sheet is controlled in a range substantially identical to that of the bubble jet recording head of the side shooter type. As a result, the consumed power in the recording head of the side shooter type is decreased.

According to the present invention, it is possible to provide the liquid jet recording head which is prodeced with ease and is durable. In addition, it is possible to record the gradational image and to arrenge nozzles at high dencity.

The present invention is not limited to the aforementioned embodiments, and variations and modifications may be made without departing from the scope of the claimed invention.

What is claimed is:

1. A liquid jet recording head comprising:

a liquid path member having a plurality of liquid flow paths which are filled with recording liquid, an orifice being formed at an end of each of said liquid flow paths;

a base member connected to said liquid path member;

a plurality of heater members formed on said base member, each of said plurality of heater members corresponding to one of said plurality of liquid flow paths of said liquid path member; and a radiator layer which is in contact with said plurality of heater members, said radiator layer having a plurality of openings each of which is located on one of said plurality of heater members, an area of each of said plurality of openings being gradually decreased in a direction toward said orifice of a corresponding liquid flow path, wherein bubbles are generated in the recording liquid in each of said liquid flow path by heat from a corresponding one of said plurality of heater members, and liquid droplets are jetted from the orifice by the bubbles.

2. The liquid jet recording head as claimed in claim 1, wherein the heat is generated from each of said plurality of heater members by power supply via electrodes connected to each of said plurality of heater members, and wherein said radiator layer is made of metal and used as one of said electrodes.

3. The liquid jet recording head as claimed in claim 1, wherein said radiator layer is put between said base member and said plurality of heater members.

* * * * *